US012471654B2

(12) United States Patent
Zou et al.

(10) Patent No.: US 12,471,654 B2
(45) Date of Patent: Nov. 18, 2025

(54) HAIR WEFT AND PREPARATION PROCESS THEREOF

(71) Applicant: WELLNA CO., LTD, KL (HK)

(72) Inventors: Junna Zou, Rongcheng (CN); Xiangpeng Lian, Rongcheng (CN); Jiarong Sun, Rongcheng (CN)

(73) Assignee: WELLNA CO., LTD, KL (HK)

( * ) Notice: Subject to any disclaimer, the term of this patent is extended or adjusted under 35 U.S.C. 154(b) by 0 days.

(21) Appl. No.: 19/218,355

(22) Filed: May 25, 2025

(65) Prior Publication Data

US 2025/0280908 A1 Sep. 11, 2025

Related U.S. Application Data

(63) Continuation of application No. 19/062,044, filed on Feb. 25, 2025, which is a continuation of application No. 18/925,063, filed on Oct. 24, 2024, now Pat. No. 12,336,580, which is a continuation-in-part of application No. 18/815,791, filed on Aug. 26, 2024, now Pat. No. 12,268,260, which is a continuation-in-part of application No. 18/410,869, filed on Jan. 11, 2024, now abandoned.

(51) Int. Cl.
*A41G 5/00* (2006.01)

(52) U.S. Cl.
CPC ..... *A41G 5/0046* (2013.01); *A41G 5/0073* (2013.01); *A41G 5/008* (2013.01)

(58) Field of Classification Search
CPC ..... A41G 5/00; A41G 5/004; A41G 5/0046; A41G 5/008; A41G 5/0053; A41G 5/0073
See application file for complete search history.

(56) References Cited

U.S. PATENT DOCUMENTS 8,434,500 B2 * 5/2013 Alex ..... A41G 5/004 132/54
2023/0040318 A1 * 2/2023 Hirano ..... A41G 5/0046

* cited by examiner

*Primary Examiner* — Rachel R Steitz
(74) *Attorney, Agent, or Firm* — Che-Yang Chen

(57) ABSTRACT

A hair weft includes a first hair weft unit and a second weft unit, the first hair weft unit includes a first hair strand and a first glue base, wherein the first hair strand is fixed to the first glue base, the second weft unit includes a second hair strand and a second glue base, wherein the second hair strand is fixed to the second glue base, wherein the first glue base is attached to the first glue base.

18 Claims, 33 Drawing Sheets

A

B

C

D

E

HAIR WEFT AND PREPARATION PROCESS THEREOF

CROSS REFERENCE

This is a Continuation Application that claims the benefit of priority under 35U.S.C. § 120 to a non-provisional application, application Ser. No. 19/062,044, filed date Feb. 25, 2025, which is a Continuation Application that claims the benefit of priority under 35U.S.C. § 120 to a non-provisional application, application Ser. No. 18/925,063, filed date Oct. 24, 2024, which is a Continuation-In-Part application that claims the benefit of priority under 35U.S.C. § 120 to a non-provisional application, application Ser. No. 18/815,791, filed date Aug. 26, 2024, which is a Continuation-In-Part application that claims the benefit of priority under 35U.S.C. § 120 to a non-provisional application, application Ser. No. 18/410,869, filed date Jan. 11, 2024, which is a non-provisional application that claims the benefit of foreign priority to Chinese Patent Application No. 202311804410.7, filed date Dec. 25, 2023; this application is also a non-provisional application that claims the benefit of foreign priority to Chinese Patent Application No. 202311405884.4, filed date Oct. 26, 2023, the entire contents of which are hereby incorporated by reference in their entirety.

TECHNICAL FIELD

The present disclosure relates to the technical field of hairdressing supplies manufacturing, specifically to hair weft.

BACKGROUND

The importance that people place on their appearance is increasing, and more and more people want to be able to change their image by changing their hairstyle. However, due to the limitations of factors such as the growth cycle and quality of hair, many people are unable to fulfill their personal hairstyle needs. In this case, hair extensions become people's first choice. As the most traditional product type in the hair product industry, hair weft has a place in the market for its wide coverage area on the head and large volume of hair.

Currently on the market, the hair weft is mostly handmade or machine-made, but the hair wefts prepared by the two production methods have obvious weft edge, which has a large thickness affecting the wearing comfort, and is not invisible enough causing obvious appearances. Further, both the above two kinds of hair wefts have folded hair, and the folded-back short hair will be in contact with the scalp when the wearer activities, resulting in a tingling sensation.

The CN Patent No. CN108835745A discloses a hair extension simulating human hair and a preparation method thereof. The hair extension includes a substrate, a hair strand, where an end of the hair strand passes through the substrate and is fixed to a back side of the substrate through an adhesive; the hair strand is flatly affixed to a front side of the substrate and is perpendicular to a length direction of the substrate. The preparation method includes: 1) making/preparing a substrate; 2) preparing a spacer; 3) preparing a hair transplantation marking area/marking paper; 4) binding auxiliary materials; 5) preparing a hair strand for hair transplantation; 6) hair transplantation; 7) cutting; 8) fixing; 9) finished product cutting: the substrate after smearing and baking is cut into the desired shape by using scissors or a knife mold; and the finished hair extension is thus made. The advantage is that the front side of the hair extensions made by the CN Patent is not required to be fixed by glue. However, the CN Patent has disclosed the production method of the hair extension but not disclosed the production method of hair wefts, and thus cannot solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation.

With the development of the economy, more and more people begin to wear hair extensions. Wearing hair extensions has the effect of appearance modification, and has advantages of simple and convenient changing hairstyles, saving time, and avoiding hair damage caused by hair perming, dyeing, and pulling. Also, the cost of doing hairstyles in the barbershop, bleaching and dyeing hair piece can be saved, which reduces expenses. Further, hairstyles can be changed at will to avoid frequent trips to the barbershop for hair styling causing damage to the hair quality. People can try a variety of hair extensions with different designs, with different fashion, which causes wearing hair extensions to become increasingly popular.

As the most traditional and oldest product type in the hair extension industry, a hair weft dominates the mainstream market with its wide head coverage and large hair volume.

However, the common hair weft products are mostly handmade or produced by a triple-head weft machine. The hand tied hair weft has a long production time and low production capacity. The machine-made hair weft, after a weft edge is folded twice by the triple-head weft machine, has an obvious folding edge and thicker weft edge, such that the wearing experience is poor. In addition, the two kinds of hair wefts have folded hair, increasing the production loss; further, the back-folded short hair will be in contact with the scalp when the wearer moves, resulting in a tingling sensation.

Currently, most hair extensions on the market are hand tied hair extensions, machine-made hair extensions or PU hair extensions. Regarding the hand tied hair extension, because of its delicate and complex production process, the production capacity is relatively low. Each hair extension requires experienced craftsmen to spend a lot of time hand-weaving, which not only leads to high processing costs, but also a very long production cycle;

During the hand-braiding process, in order to ensure the firmness and naturalness of the hair extension, a longer folded back hair (about 1.5 to 2 inches) is usually required. However, this also means that there will be a greater loss of raw materials during the production process, which increases costs.

After the hem of the hair extension is cut, additional processing steps are required to ensure the stability and comfort of the hair extension. Usually, a portion of the hair needs to be removed and then three strands of rope are tied to make the hair extension better fixed on the wearer's head. This process adds extra work and also increases the installation time of the hair extension.

Due to the characteristics of hand-knitting technology, the number of hair strands per unit area is small and the amount of hair is extremely small. This means that hand-braided hair extensions have a limited ability to increase hair volume, and those who wish to significantly increase hair volume or achieve a fuller hairstyle may need to use multiple hair extensions to achieve the desired effect.

Regarding the machine-made hair extension, during the manufacturing process, a machine is used to fold the hair roots in half twice, sew them with sewing threads, and then use a stitching machine to stitch them together. Although this manufacturing process helps improve the structural strength and durability of the hair extension, it also creates a problem: the edges of the hair extension become relatively thick. This thickened edge may cause discomfort to the user when wearing it, especially in the area close to the scalp, where the user may feel pressure or foreign body sensation, thus affecting the overall wearing experience.

Because the hair roots are folded in half, there will be some hair folded back at the folded edge. These short hairs are usually located at the edge of the hair extension. When the wearer turns his head, lowers his head or raises his head, these short hairs may pierce the scalp, causing discomfort or even pain. This tingling sensation not only affects the wearer's comfort experience, but may also make people feel irritable, especially when wearing it for a long time, the problem will be more obvious.

Due to daily friction, pulling, cleaning and maintenance, the sewing thread may gradually wear out. Once the sewing thread wears to a certain extent and breaks, it will cause part or all of the hair extension to be out of place, thus affecting its wearing effect. This situation will not only reduce the service life of the hair extension, but may also make the user feel embarrassed at a critical moment.

The PU hair extension products include the ordinary PU hair extension and the PU hair extension made by machine insertion. The edge design of the ordinary PU hair extension is too flat and lacks the necessary three-dimensional sense. This design results in the hair extension not being able to blend perfectly with the wearer's original hair after wearing it. Especially for those who want to achieve a natural transition effect, such as at the hairline or the top of the head, this lack of three-dimensionality will cause a clear dividing line between the hair extension and the original hair. The overall hairstyle therefore appears unnatural and gives people a "fake" feeling, which not only reduces the overall beauty of the wearer, but may also affect their self-confidence;

The surface of the weft edge is relatively smooth, which will produce obvious light reflection under direct sunlight. This reflective effect may make the hair extension too conspicuous and easy to be noticed by others. Especially in outdoor activities or sunny environments, this strong reflection phenomenon will enhance the presence of the hair extension, thereby reducing the naturalness of the overall hairstyle and making the hair extension easier to be discovered by others.

The machine-insertion technology for the PU hair extension can ensure the stability and invisible effect of the hair extension to a certain extent, the density of the implant needles is limited, which limits the increase in hair volume. For those who want to achieve a full and thick effect, this limitation may be an obvious disadvantage.

In addition, higher processing costs and longer production cycles mean that consumers need to pay more and wait longer to receive the products. Coupled with the inevitable loss of raw materials during the production process, this further pushes up the cost of the final product.

SUMMARY OF THE DISCLOSURE

The present disclosure is intended to solve at least one of the technical problems of the prior art. To this end, a first aspect of the present disclosure proposes a hair weft, including:

a first hair weft, including a hair transplantation base and a first hair strand; wherein the hair transplantation base includes a mesh base and a spacer disposed above the mesh base; the spacer is configured to clamp the first hair strand after the first hair strand passes through the mesh base and the spacer; the mesh base is configured to affix the first hair strand to a side of the mesh base after the spacer and the mesh base are separated; and a second hair weft, including a second hair strand; wherein a top of the second hair strand is fixed through a quilting line and a glue; wherein the second hair weft is cut and affixed flush to a bottom of the first hair weft, forming the hair weft.

In some embodiments, a material of the mesh base is a non-stretchy, densely perforated, ultra-thin mesh silk yarn.

In some embodiments, a material of the spacer is PVC artificial leather.

The embodiments of the present disclosure further propose a preparation method of the hair weft, including:

Step 1, preparing the hair transplantation base: cutting the mesh base and the spacer to a predetermined shape, marking a hair transplantation area on the spacer, and aligning the mesh base and the spacer to be bound together;

Step 2, preparing the first hair strand and placing the first hair strand in a predetermined area;

Step 3, preparing the first hair weft: after passing the first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft;

Step 4: preparing the second hair weft: fixing a top of the second hair strand that is organized to a same height through two quilting lines and further fixing with the glue;

Step 5, preparing the hair weft: cutting the first hair weft and the second hair weft, and affixing the second hair weft flush to the bottom of the first hair weft; and Step 6, cleaning treatment: soaking the hair weft in an alkaline solution, and soaking the hair weft in a softener.

In some embodiments, the Step 2 includes:

organizing the first hair strand to a uniform height;

fixing a middle part of the first hair strand;

placing the first hair strand in a transplantation area of a transplantation machine; and placing the mesh base and the spacer in turn above the transplantation area.

In some embodiments, the Step 3 includes:

utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area;

cutting the first hair strand located between the spacer and the mesh base, affixing the first hair strand to the mesh base through an adhesive, and drying; and cutting the first hair strand on the side of the mesh base away from the spacer to 0.1 to 2 cm, to obtain the first hair weft.

In some embodiments, the Step 4 includes:

organizing the second hair strand to a uniform height;

forming the two quilting lines on the top of the second hair strand through a double-needle sewing machine;

applying a tape 1.2 to 1.5 inches from the top of the second hair strand; and applying a preprepared glue to evenly coat the tape to the top of the second hair strand, and drying.

In some embodiments, the Step 6 includes:

putting 100 g of the hair weft into 1 kg of 40° C. water, adding 2 g to 3 g of sodium hypochlorite solution, and soaking for 5 minutes;

cleaning the hair weft for three times using 40° C. water;

after the cleaning, putting the hair weft into 1 kg of 50° C. water, adding 30 g of softener, and soaking for 10 minutes; and after the cleaning, putting the hair weft into 1 kg of 50° C. water, adding 40 g of softener, and soaking for 10 minutes.

The embodiments of the present disclosure provide a hair weft and a preparation process thereof, which have the following beneficial effects compared with the prior art:

By providing the hair transplantation base, the first hair strand, the first hair weft, the second hair weft, the finished hair weft, and cleaning and processing, a hair weft close to the state of human hair growth is obtained. There is no weft edge in the conventional sense of the traditional hair weft. After wearing, the hair weft blends in with the wearer's own hair, which is more invisible. No hair back occurs, which enhances the wearing experience, solving the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

The present invention is advantageous in that it provides a hair weft and preparing method thereof, wherein the hair weft comprises a first hair weft unit and a second hair weft unit, the first hair weft unit comprises a hair transplantation base and a first hair strand which is transplanted on the hair transplantation base, the second hair weft unit comprises a second hair strand which is attached to the hair transplantation base, so as to increase the hair volume of the hair weft product.

Another advantage of the present invention is to provide a hair weft and preparing method thereof, wherein the first hair weft unit may have a insufficient bristle density and volume which fail to meet the desired standards for a larger hair volume, wherein the second hair weft unit with a higher bristle density and volume is produced and is combined with the first hair weft unit using an adhesive to achieve the required hair volume. Accordingly, combining two hair weft units compensates for the lower volume of the first hair weft unit to result in a final product that meets the volume requirements.

Another advantage of the present invention is to provide a hair weft and preparing method thereof, wherein the hair transplantation base is glued between the two hair strands, so as to ensure a strong bond and help in achieving a seamless integration of the two hair weft units.

Another advantage of the present invention is to provide a hair weft and preparing method thereof, wherein this method allows for flexibility in adjusting the hair volume by changing the density of either the first or the second hair weft unit.

Another advantage of the present invention is to provide a hair weft and preparing method thereof, wherein a top of the first hair strand body is extending from a top edge of the hair transplantation base and naturally draping over it in a curved manner, the second hair strand body is extending from a bottom edge of the hair transplantation base, the starting points of their extensions are different, with the more curled first hair strand overlaying the second hair strand, a layered and three-dimensional effect is created, so that the difference in starting points adds visual depth and texture, mimicking the natural layering of hair.

Another advantage of the present invention is to provide a hair weft and preparing method thereof, wherein the second hair strand has a higher density, providing greater thickness and being positioned closer to the scalp when the hair weft is worn on a head of the user, so that this arrangement simulates the natural decrease in hair density from the scalp toward outward, so as to enhance the sense of layering. In other words, this structure mimics the natural distribution of hair density, which is higher near the scalp and decreases outward, so as to provide a more realistic transition from scalp to ends. The layered structure also allows for versatile styling options, accommodating various looks and preferences.

Another advantage of the present invention is to provide a hair weft and preparing method thereof, wherein both hair weft units are positioned vertically during the assembly process, this ensures that the hair strands align properly and maintain the intended orientation.

According to another aspect, the present invention provides a hair weft, comprising:

a first hair weft unit comprising a first hair strand a hair transplantation base, wherein the first hair strand is fixed to the hair transplantation base; and a second weft unit comprising a second hair strand and an attaching base, wherein the second hair strand is fixed to the attaching base, wherein the attaching base is attached to the hair transplantation base.

According to an embodiment, the first hair strand comprises a first hair strand body and a first root portion integrally extended from the first hair strand body, wherein the first root portion is penetrating through the hair transplantation base and adhered to the hair transplantation base, wherein the first hair strand body and the first root portion are provided at two opposite sides of the hair transplantation base.

According to an embodiment, the hair transplantation base comprises a silk mesh and a glue layer applied on the silk mesh.

According to an embodiment, the second hair strand comprises a second hair strand body and a second root portion integrally extended from the second hair strand body, wherein the second root portion of the second hair strand is fixed to the attaching base.

According to an embodiment, the attaching base of the second weft unit is formed by a glue material, wherein the second root portion of the second weft unit is embedded in the attaching base.

According to an embodiment, the glue material of the attaching base of the second weft unit comprises a mixture of polyurethane glue, adhesive, and thinner.

According to an embodiment, in the glue material of the attaching base of the second weft unit, a weight content of polyurethane glue is ranged from 40%-60%, a weight content of adhesive is ranged from 10%-30%, and a weight content of thinner is ranged from 20%-40%.

According to an embodiment, the attaching base of the second weft unit comprises an attache tape.

According to an embodiment, the first hair strand body of the first hair strand and the second hair strand body of the second hair strand are provided at two opposite sides of the hair transplantation base.

According to an embodiment, a density of the first hair strand is lower than a density of the second hair strand.

According to an embodiment, the first hair strand body of the first hair strand is extended from a front surface of the hair transplantation base, a top end of the second hair strand body of the second hair strand is extended from a bottom edge of the attaching base corresponding to a position of a bottom edge of the hair transplantation base.

According to an embodiment, the first hair strand body is extended from a front surface of the hair transplantation base and is draping over the hair transplantation base in a curved manner and is layered on on top of the second hair strand body.

According to an embodiment, the hair weft further comprises an attaching unit which is mounted to the second weft unit for detachably mounting the hair weft to a hair of a user.

According to an embodiment, the second hair weft unit is provided between the attaching unit and the first hair weft unit, wherein the second hair strand has a higher density than the first hair strand to create a layering effect when the hair weft is worn on the user.

According to an embodiment, the attaching unit comprises a clipping member which is mounted to the attaching base of the second hair weft unit.

According to an embodiment, the attaching unit comprises a double-sided binding tape which is attached to the attaching base.

According to another aspect, the present invention provides a preparation method of a hair weft, comprising the following steps:

prepare a first hair weft unit comprising a first hair strand and a hair transplantation base, wherein the first hair strand is affixed on the hair transplantation base; and affix an attaching base of a second hair weft unit to the hair transplantation base, wherein the second hair weft unit comprises a second hair strand fixed to the attaching base, wherein the first hair strand and the second hair strand are provided at two opposite sides of the hair transplantation base to increase a hair volume of the hair weft.

According to an embodiment, the step (a) comprises a step of guiding a first root portion of the first hair strand to penetrate through the hair transplantation base and then affixing the first root portion of the first hair strand to the hair transplantation base.

According to an embodiment, the step (b) comprises a step of applying a glue material to a second root portion of the second hair strand to form the attaching base, wherein the second root portion of the second hair strand is embedded into the attaching base.

The present invention also provides a preparation method of a hair weft, which has a high production efficiency and has no short hair folding back.

The present disclosure provides a preparation method of a hair weft, comprising the following steps.

S1: batching hair strands according to a target weight to obtain a hair handle;

S2: forming a first quilting line and a second quilting line on a top of the hair handle with a double-needle sewing machine to obtain the hair weft;

S3: forming a third quilting line between the first quilting line and the second quilting line of the hair weft with a single-needle sewing machine;

S4: pasting a tape along the third quilting line to cause the tape to cover the hair weft;

S5: applying a glue between the first quilting line and the third quilting line, and drying the hair weft;

S6: cutting the hair weft along the first quilting line;

S7: soaking the hair weft in a softener; and

S8: putting the hair weft into a centrifuge for dehydration and shaking, and combing the hair strands.

In some embodiments, in S2, the first quilting line is a cotton sewing thread and the second quilting line is a water-soluble sewing thread.

In some embodiments, the double-needle sewing machine has a gauge of 30-35 stitches per inch, and a spacing between the first quilting line and the second quilting line is 3-4 mm.

In some embodiments, in S3, the third quilting line is a cotton sewing thread, and a spacing between the third quilting line and the first quilting line is 1 mm.

In some embodiments, S5 comprises the following steps.

S51: applying a first glue between the first quilting line and the third quilting line on a front side of the hair weft, and drying the hair weft at a drying temperature of 45-50° C. for 15 minutes;

S52: applying a second glue between the first quilting line and the third quilting line on the front side of the hair weft, and drying the hair weft at a drying temperature of 45-50° C. for 15 minutes;

S53: applying a third glue between the first quilting line and the third quilting line on the front side of the hair weft, and drying the hair weft at a drying temperature of ° C. for 120 minutes;

S54: applying a fourth glue between the first quilting line and the third quilting line on a back side of the hair weft, and drying the hair weft at a drying temperature of 45-50° C. for 15 minutes;

S55: applying a fifth glue between the first quilting line and the third quilting line on the back side of the hair weft, and drying the hair weft at a drying temperature of 45-50° C. for 15 minutes; and

S56: applying a sixth glue between the first quilting line and the third quilting line on the back side of the hair weft, and drying the hair weft at a drying temperature of 45-50° C. for 240 minutes.

In some embodiments, the S7 comprises the following steps.

S71: adding 2 g-3 g of a sodium hypochlorite solution to 1 kg of water at 40° C. to obtain a first solution, and soaking the hair weft in the first solution for 5 minutes;

S72: washing the hair weft with water at 40° C.;

S73: adding 30 g of the softener to 1 kg of water at 50° C. to obtain a second solution, and soaking the hair weft in the second solution for 10 minutes; and

S74: adding 40 g of the softener to 1 kg of water at 50° C. to obtain a third solution, and soaking the hair weft in the third solution for 10 minutes.

In some embodiments, S8 comprises the following steps: placing the hair weft into the third solution to be slightly moistened, unfolding and laying flat the hair weft, scraping out water, and drying the hair weft.

In some embodiments, S1 comprises the following step: dyeing the hair strands before the batching.

In some embodiments, the preparation method further comprises the following steps: S9: ironing and combing the hair weft, stacking the hair weft, and bundling and packaging for transportation.

The present disclosure provides a preparation method of a hair weft, including: batching hair strands according to a target weight to obtain a hair handle; forming a first quilting line and a second quilting line on a top of the hair handle with a double-needle sewing machine to obtain the hair weft; forming a third quilting line between the first quilting line and the second quilting line of the hair weft with a single-needle sewing machine; pasting a tape along the third quilting line to cause the tape to cover the hair weft; applying a glue between the first quilting line and the third quilting line, and drying the hair weft; cutting the hair weft along the first quilting line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

Another advantage of the present invention is to provide a hair weft and a preparation method thereof. The hair weft is a PU product and is different from an ordinary PU hair extension. The hair weft is made of two layers of hair weft units bonded together. The upper hair weft unit is fixed with two sewing lines with extremely narrow intervals to form a cluster of hair bundles. After being coated with glue and dried and fixed, the edge of the upper hair weft unit is in an irregular hair bundle shape, and the appearance is similar to that of a hand tied and hair extension. The lower hair weft unit is a PU hair extension. The upper and lower hair weft units are firmly bonded by glue to form a finished hair weft.

Another advantage of the present invention is to provide a hair weft and a preparation method thereof, wherein compared with hand tied hair weft, this hair weft is made of PU material has lower processing costs and shorter production cycles, and its production capacity is greatly improved. Due to its material characteristics, the PU weft edge is very strong and will not be affected by the breakage of the braided wire, thus extending its service life. In addition, this hair weft can be cut at will according to the needs of the wearer, with neat cuts and no hair loss. It can be used directly after cutting without additional processing, which greatly shortens the installation time. In terms of hair volume, this hair weft is far superior to hand tied hair weft, and can achieve 1 to 1.5 times the weight under the condition of the same edge width.

Another advantage of the present invention is to provide a hair weft and a preparation method thereof, wherein compared with the machine weft, the weft edge of this hair weft does not have the phenomenon of back-spinning, and the hair will not be reversely sewn on the edge, making the weft edge smoother and more natural. This design not only makes the weft edge appear softer and thinner, but also makes it almost imperceptible when worn, greatly improving the wearer's comfort. The PU edge is very strong and will not be affected by the breakage of the braided wire, thus extending the service life.

Another advantage of the present invention is to provide a hair weft and a preparation method thereof, wherein compared with the ordinary PU hair weft, the production process of the upper hair weft units adopts a segmented fixing method, that is, the hair is fixed in sections in advance with sewing thread. This process not only gives the weft edge a more three-dimensional effect, but also makes the hair weft and the wearer's original hair blend more naturally, and the dividing line is almost invisible. This three-dimensional design has an additional benefit, that is, due to the irregularity of the weft edge, the chance of direct light reflection is reduced, so even in the sun, the hair weft will not appear too bright, but present a more real and soft luster. Such improvements make the overall effect of the hair weft closer to the hair in its natural state, greatly enhancing the realism and beauty of wearing.

Another advantage of the present invention is to provide a hair weft and a preparation method thereof, wherein compared with injected PU hair weft, due to the abandonment of machine-insertion technology, the new hair weft is no longer limited by the needle density, which means that more hair strands can be implanted on the same size hair extension, thereby significantly increasing the hair volume of the hair weft and makes it look thicker and more natural. In addition, due to different production processes, the processing cost of this hair weft unit is lower, which allows consumers to enjoy high-quality products at more affordable prices. At the same time, the production cycle has also been greatly shortened, which means faster supply speed and higher production capacity. This efficient production method can not only meet the needs of more consumers, but also provide merchants with greater flexibility and market competitiveness. In general, the new hair weft not only provides a better user experience, but also brings economic advantages.

Another advantage of the present invention is to provide a hair weft and a preparation method thereof, wherein the hair weft can not only be used as an ordinary weft, by sewing metal clips on the mesh yarn surface of the hair weft, it becomes a clip-in that is easy to install quickly, which is very suitable for temporary changes in style. In addition, if it is provided with a double-sided tape on the mesh yarn surface and then cut it appropriately, it can be transformed into a tape-in. This form of the hair weft is more suitable for long-term wear and can be more firmly fixed on the hair. This diverse use method allows this hair extension to meet the needs of different occasions and personal preferences.

The present application provides a hair weft, comprising:

a first hair weft unit comprising a first hair strand and a first glue base, wherein the first hair strand is fixed to the first glue base; and a second weft unit comprising a second hair strand and a second glue base, wherein the second hair strand is fixed to the second glue base, wherein the first glue base is attached to the second glue base.

According to an embodiment, the first hair strand comprises a first hair strand body and a first root portion integrally extended from the first hair strand body, wherein the first root portion is embedded into the first glue base.

According to an embodiment, the first hair weft unit further comprises a first quilting line and a third quilting line which are fixed on the first hair strand.

According to an embodiment, the first glue base is provided between the first quilting line and the third quilting line.

According to an embodiment, a distance between the first quilting line and the third quilting line is smaller than 3 mm.

According to an embodiment, a distance between the first quilting line and the third quilting line is 0.5 mm to 2 mm.

According to an embodiment, a distance between the first quilting line and the third quilting line is 1 mm.

According to an embodiment, the first quilting line and the third quilting line are parallel cotton threads.

According to an embodiment, the first quilting line is applied on the first hair strand by a double-needle machine which is able to apply the first quilting line and a second quilting line, wherein the third quilting line is applied on the second hair strand by a single-need machine between the first quilting line and the second quilting line, wherein the first quilting line and the third quilting line are cotton threads, wherein the second quilting line is water-soluble and is removed during a soaking process.

According to an embodiment, the second hair strand comprises a second hair strand body and a second root portion integrally extended from the second hair strand body, wherein the second root portion of the second hair strand is embedded into the second glue base.

According to an embodiment, the first glue base comprises one of polyurethane glue and polycarbonate glue.

According to an embodiment, the second glue base comprises one of polyurethane glue and polycarbonate glue.

According to an embodiment, the first glue base comprises one of polyurethane glue and polycarbonate glue, an adhesive and a thinner, wherein a weight content of polyurethane glue or polycarbonate glue is ranged from 40%-60%, a weight content of the adhesive is ranged from 10%-30%, and a weight content of the thinner is ranged from 20%-40%.

According to an embodiment, the second glue base comprises one of polyurethane glue and polycarbonate glue, an adhesive and a thinner, wherein a weight content of polyurethane glue or polycarbonate glue is ranged from 40%-60%, a weight content of the adhesive is ranged from 10%-30%, and a weight content of the thinner is ranged from 20%-40%.

According to an embodiment, a length of the first glue base is smaller than a length of the second glue base.

According to an embodiment, the second hair weft unit further comprises a mesh yarn attached on the second glue base.

According to an embodiment, an attaching unit is mounted to the second weft unit for detachably mounting the hair weft to a hair of a user.

According to an embodiment, the attaching unit comprises one of a clipping member and a double-sided binding tape.

The present invention further provides a preparation method of a hair weft, comprising the following steps.

(I) Prepare a first hair weft unit comprising a first hair strand and a first glue base, wherein the first hair strand is fixed to the first glue base.

(II) Prepare a second hair weft unit comprising a second hair strand and a second glue base, wherein the second hair strand is fixed to the second glue base.

(III) Affix the first glue base to the second glue base.

According to an embodiment, the step (I) of preparing the first hair weft unit comprises a step of forming a first quilting line and a second quilting line on the first hair strand before forming the first glue base.

According to an embodiment, the step (I) of preparing the first hair weft unit comprises the following steps.

Form a first quilting line and a second quilting line on a top of the first hair strand by a double-needle sewing machine to obtain a first hair weft material, the first quilting line is a cotton sewing thread and the second quilting line is a water-soluble sewing thread.

From a third quilting line between the first quilting line and the second quilting line of the first hair weft material with a single-needle sewing machine, the third quilting line is a cotton sewing thread, and a distance between the third quilting line and the first quilting line is smaller than 3 mm.

Attach a first masking tape along the third quilting line to cause the first masking tape to cover the first hair weft material.

Apply a glue material for forming the first glue base between the first quilting line and the third quilting line, and dry the first hair weft material.

Cut the first hair weft material along the first quilting line and remove the first masking tape.

According to an embodiment, the step (II) of preparing the second hair weft unit comprises the following steps.

Form a water-soluble sewing thread by a single-needle sewing machine on the second hair strand to provide a second hair weft material.

Stick a second masking tape on a top of the second hair weft material.

Apply a glue material for forming the second glue base on the hair strand at a position above the second masking tape.

Cut an excess weft edge and remove the second masking tape to obtain the second hair weft unit.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

The present specification provides steps for operating the method as described in the embodiments or flowcharts, but more or fewer steps may be included based on routine or unoriginal labor. When executed in a real-world system or server product, the methods may be executed sequentially or in parallel (e.g., a parallel processor or multi-threaded processing environment) as shown in the embodiments or the accompanying drawings.

Figure 1:
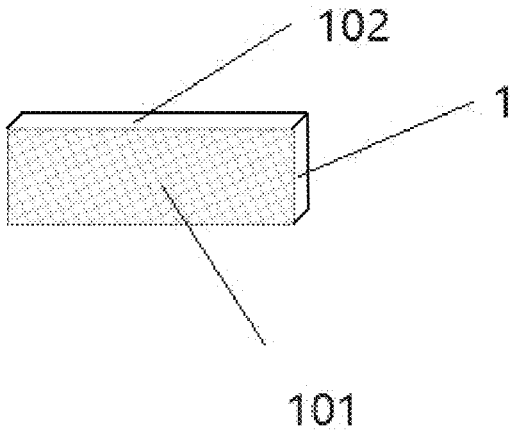
FIG. 1 is a structural schematic view of a hair transplantation base of a hair weft according to some embodiments of the present disclosure.
Figure 2:
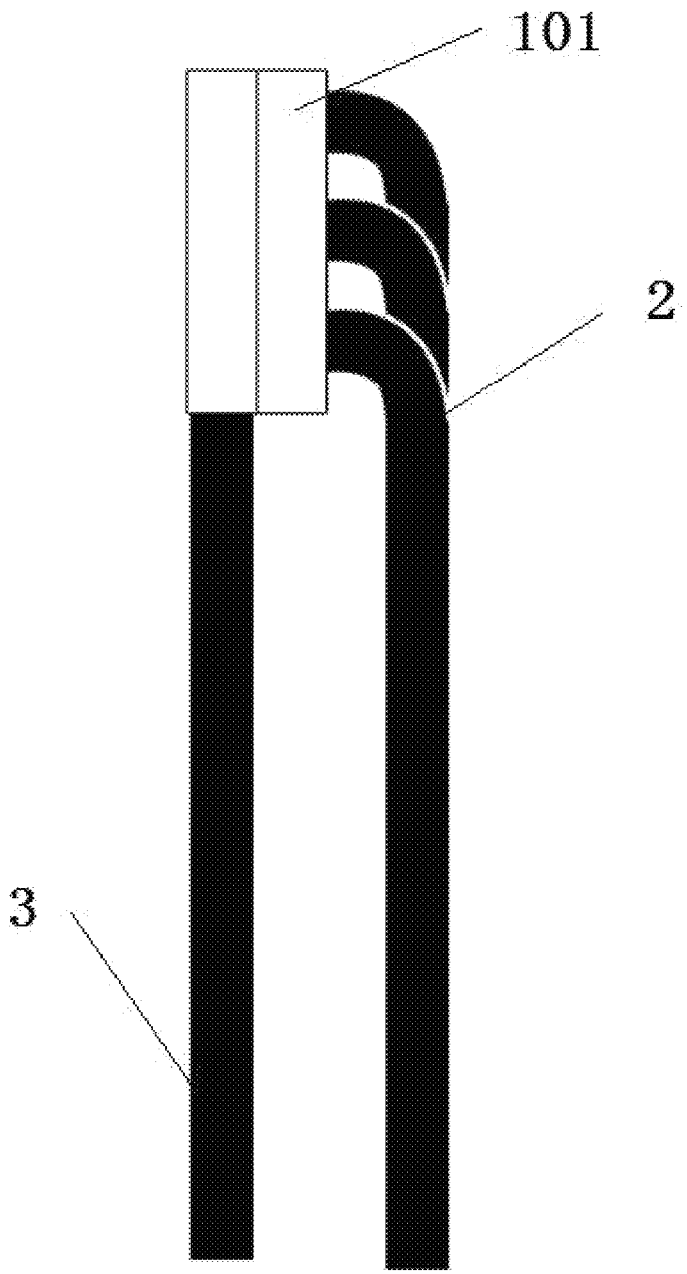
FIG. 2 is a structural schematic view of a first hair weft and a second hair weft of a hair weft after being affixed according to some embodiments of the present disclosure.

FIG. 1 is a structural schematic view of a hair transplantation base of a hair weft according to some embodiments of the present disclosure, and FIG. 2 is a structural schematic view of a first hair weft and a second hair weft of a hair weft after being affixed according to some embodiments of the present disclosure. The hair weft refers to skin weft, which can be directly braided onto the head. The embodiments of the present disclosure are intended to solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation. Referring to FIGS. 1 and 2, the structure of the hair weft includes:

- a first hair weft, including a hair transplantation base 1 and a first hair strand 2;
- where the hair transplantation base 1 includes a mesh base 101 and a spacer 102 disposed above the mesh base 101; the spacer 102 is configured to clamp the first hair strand 2 after the first hair strand 2 passes through the mesh base 101 and the spacer 102; the mesh base 101 is configured to affix the first hair strand 2 to a side of the mesh base 101 after the spacer 102 and the mesh base 101 are separated;
- a second hair weft, including a second hair strand 3; where a top of the second hair strand 3 is fixed through quilting line and glue;
- where the second hair weft is cut and affixed flush to a bottom of the first hair weft to obtain the hair weft.

The present disclosure can solve the problem, that existing hair wefts have folded hair and the folded-back short hair will be in contact with the scalp when the wearer activities, resulting in a tingling sensation, by affixing the second hair weft at the bottom of the first hair weft in a flush-fit manner. Moreover, by fixing the first hair strand 2 to one side of the mesh base 101, the mesh base has no obvious weft edge, which has a smaller thickness and is comfortable to wear. The second hair weft made by the second hair strand 3 is attached to the bottom of the first hair weft to make the finished hair weft, which has the effect of being invisible, such that the hair weft is not obvious after being worn. Because the first hair weft has a low density and volume of hair transplantation and cannot satisfy our demand for a large volume of hair, the second hair weft with a relatively large volume of hair is additionally made, and the first and second hair wefts are affixed together by means of an adhesive. To make the hair weft, the first and second hair wefts are placed vertically, and then the roots of the two hair wefts are affixed together by means of the adhesive.

In some embodiments, the material of the mesh base 101 is a non-stretchy, densely perforated, ultra-thin mesh silk yarn.

In the embodiments, the silk yarn may be Korean silk. The silk yarn is selected from the short fibers of silk by spinning and regeneration. Goods made from silk yarn or yarn woven in a plain arrangement are called silk. The texture of silk is tight and frivolous, with fine and clean surface, lubricating and flat, glossy and soft, to be used as clothing material and decorative items. Korean silk is one of the series of silk fabrics produced by combining the characteristics of Korean silk products with Chinese weaving technology. The mesh base 101 made of Korean silk has no visible weft edges, which is less thick and is comfortable to wear.

In some embodiments, the material of the spacer 102 is PVC artificial leather.

The material of the spacer 102 in the embodiments is PVC artificial leather with a thickness of 0.4 mm. A curved hook carried at a top of a needle of a transplantation machine can pierce the spacer 102 and the mesh base 101 in turn when it moves up and down, and the curved hook at the top of the needle hooks the first hair strand 2 and brings the first hair strand 2 out of the pierced hole, and the spacer 102 shrinks after the needle has been withdrawn from the hole to clamp the first hair strand 2. The spacer 102 made of PVC artificial leather has better shrinkage and is cheap and easy to obtain.

Figure 3:
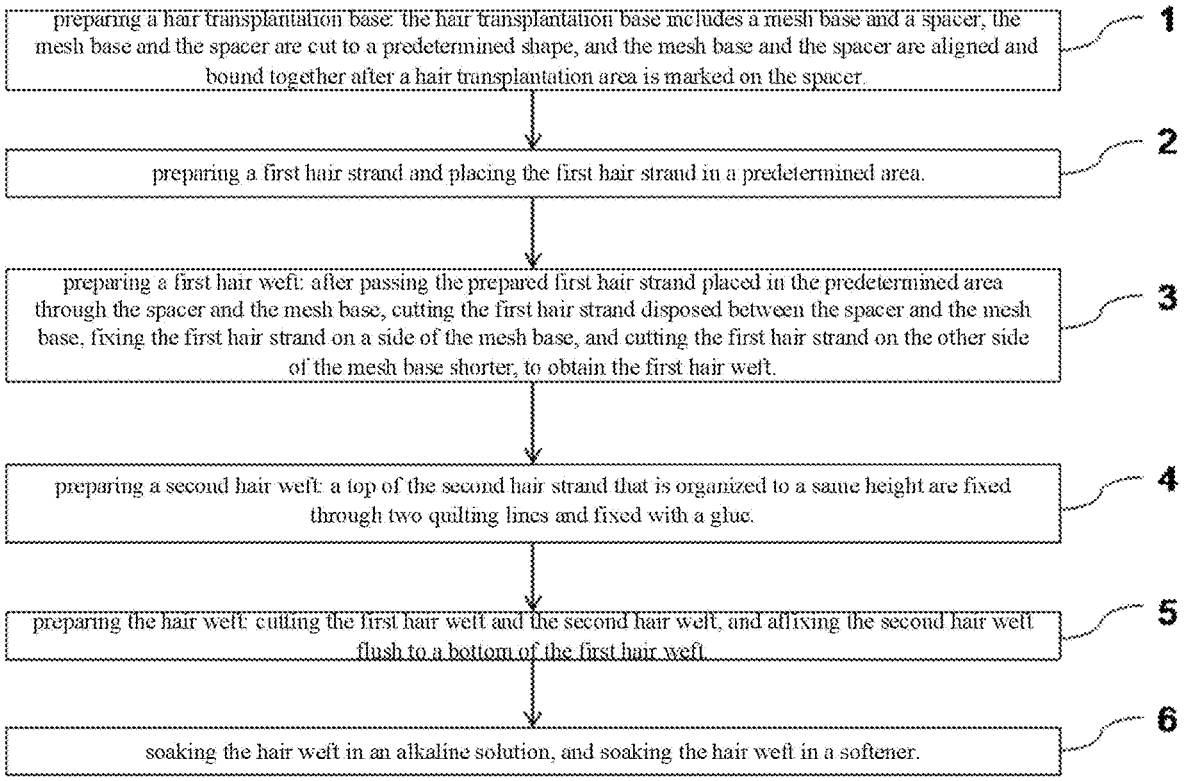
FIG. 3 is a flowchart of a preparation process of a hair weft according to some embodiments of the present disclosure.
Figure 4:
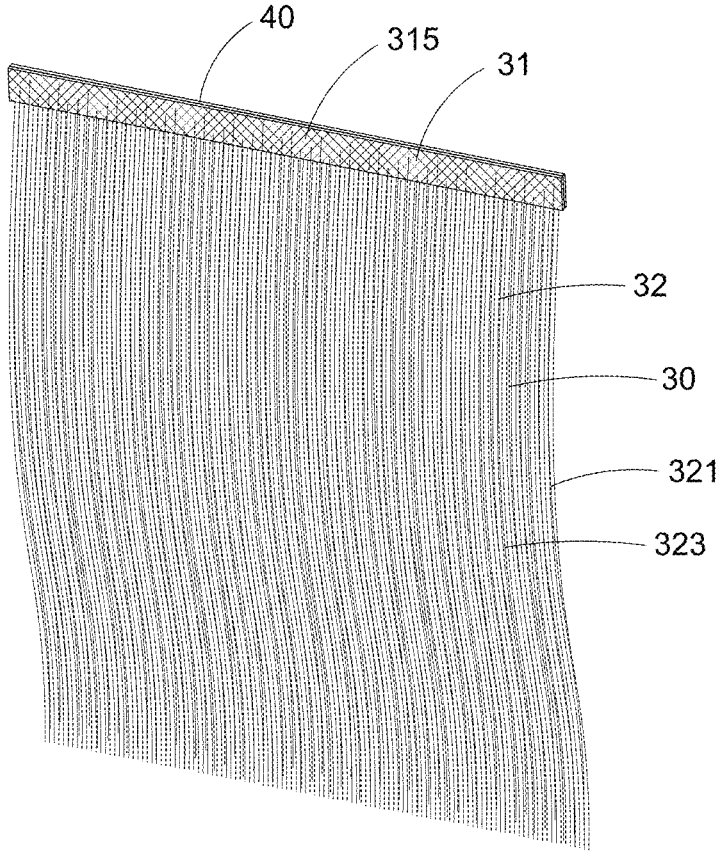
FIG. 4 is a perspective view of a hair weft according to a preferred embodiment of the present invention.
Figure 5A:
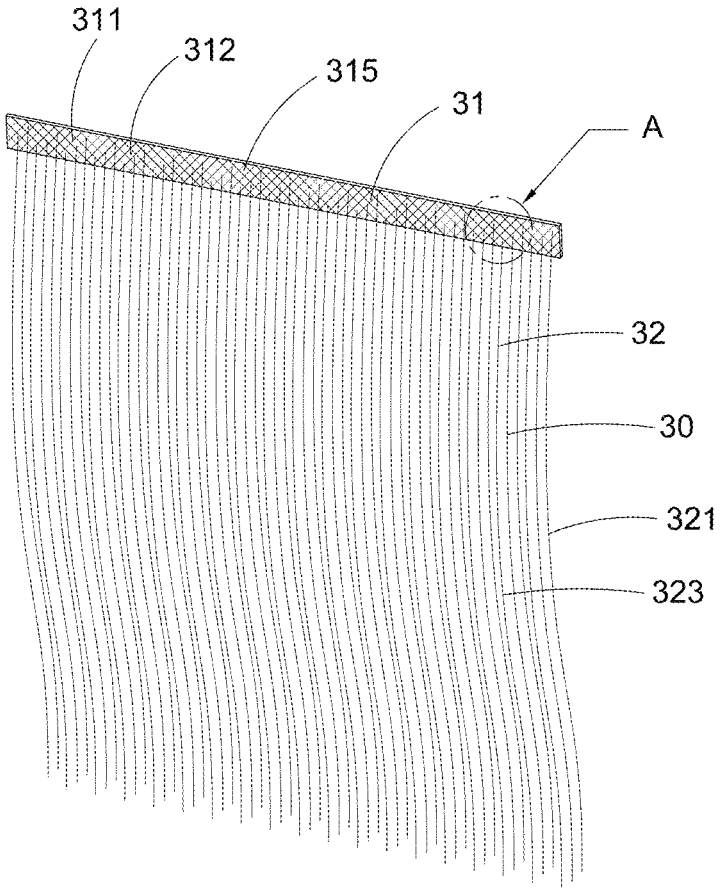
FIG. 5A is a perspective view illustrating a front side of a first hair weft unit of the hair weft according to the above preferred embodiment of the present invention.
Figure 5B:
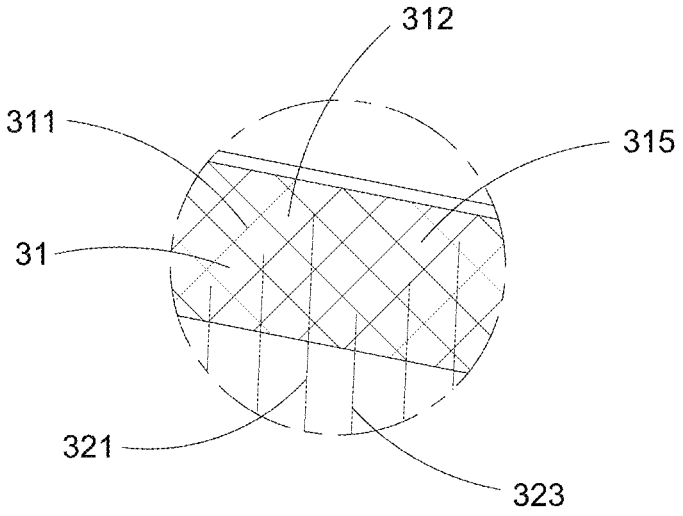
FIG. 5B is an partial enlarged view of area A in FIG. 5A.
Figure 6A:
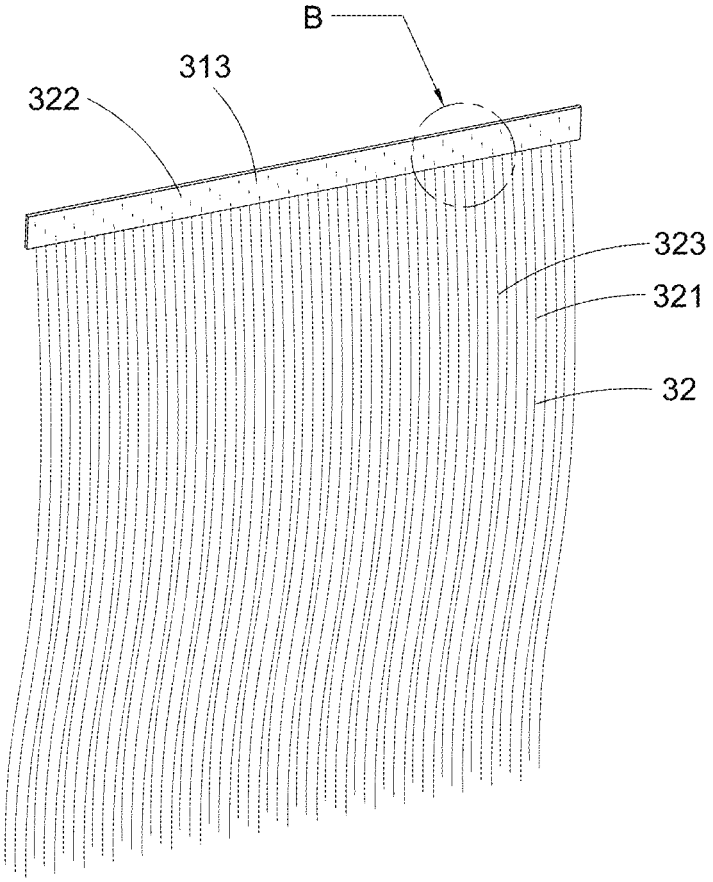
FIG. 6A is a perspective view illustrating a rear side of the first hair weft unit of the hair weft according to the above preferred embodiment of the present invention.
Figure 6B:
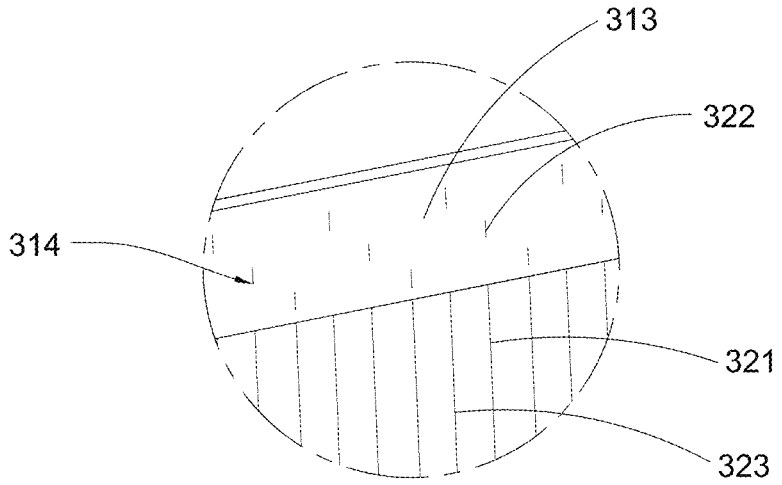
FIG. 6B is an partial enlarged view of area B in FIG. 5A.

FIG. 3 is a flowchart of a preparation process of a hair weft according to some embodiments of the present disclosure. Referring to FIG. 3, the embodiments of the present disclosure further provide a preparation process of a hair weft, including:

Step 1, preparing a hair transplantation base: the hair transplantation base includes a mesh base and a spacer, the mesh base and the spacer are cut to a predetermined shape, and the mesh base and the spacer are aligned and bound together after a hair transplantation area is marked on the spacer.

Specifically, the implementation steps of preparing the hair transplantation base include:

Step 101, cutting the mesh base and spacer to a desired shape and length.

Step 102, marking the desired hair transplantation area on the spacer with a marker.

Step 103, overlapping the mesh base and spacer, and binding and fixing the mesh base and the spacer with a stapler.

Step 2, preparing a first hair strand and placing the first hair strand in a predetermined area.

Specifically, the implementation steps of preparing a first hair strand and placing the first hair strand in the predetermined area include:

Step 201, organizing the first hair strand to a uniform height.

In step 201, a top of the first hair strand is tapped flush with a clapper board, and hair that is too short is lifted by hand to keep the overall height of the first hair strand consistent.

Step 202: fixing a middle part of the first hair strand.

In step 202, the middle part of the first hair strand is placed in two hair-beating splints with curved pins for fixing.

Step 203: placing the first hair strand in a transplantation area of a transplantation machine.

In step 203, the first hair strand is placed flat on top of the transplantation area of the transplantation machine.

Step 204: placing the mesh base and the spacer in turn above the transplantation area.

In step 204, the fabricated hair transplantation base is placed on top of the first hair strand, with the mesh base on the bottom and the spacer on the top.

Step 3, preparing a first hair weft: after passing the prepared first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft.

Specifically, the implementation steps of step 3 include:

Step 301, utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area.

In step 301, a top of a needle of the transplantation machine is arranged with a curved hook, and the curved hook pierces the spacer 102 and the mesh base 101 in turn when the needle moves up and down; upon reaching the first hair strand, the curved hook on the top of the needle hooks some of the first hair strand, and brings the some of the first hair strand out of the pierced hole, and the spacer shrinks after the machine needle is withdrawn from the hole, to clamp the some of the first hair strand. Step 301 is repeated until the first hair strand is completely transplanted in the hair transplantation area.

Step 302, cutting the first hair strand located between the spacer and the mesh base, affixing the first hair strand to the mesh base through an adhesive, and drying.

In step 302, the hair transplantation base after the hair transplantation is completed is removed from the first hair strand, and the hair strand between the mesh base and the spacer is cut through scissors to separate the mesh base from the spacer. An adhesive is applied to the first hair strand and dried in an oven. The first hair strand on the back of the mesh base is pressed down and ironed it flat through an iron such that the first hair strand is parallel to the mesh base. The adhesive is applied again to the first hair strand on the back of the mesh base and dried in the oven.

Step 303: cutting the first hair strand on the side of the mesh base away from the spacer to 0.1 to 2 cm, to obtain the first hair weft.

In step 303, the first hair strand on the back of the mesh base is trimmed to 0.1 to 2 cm through electric push shears to obtain the first hair weft.

Step 4: preparing a second hair weft: a top of the second hair strand that is organized to a same height are fixed through two quilting lines and fixed with a glue.

Specifically, the implementation steps of step 4 include:

Step 401, tapping the top of the second hair strand flush with a clapper board, and hair that is too short is lifted by hand to keep the overall height of the second hair strand consistent.

Step 402, forming the two quilting lines on the top of the second hair strand through a double-needle sewing machine, to obtain a fixed preparatory hair weft.

Step 403, applying a masking tape 1.2 to 1.5 inches from a top of the preparatory hair weft to prevent the glue from penetrating into the second hair strand at a bottom during a subsequent brushing step, thereby achieving a shaping effect.

Step 404, mixing polyurethane glue, adhesive, and thinner in proportion to obtain a special glue for making the weft edge.

Step 405, applying the glue at a position above the masking tape, utilizing a scraper to repeatedly scrape the glue such that the glue contacts the second hair strand uniformly for fixing, and placing the second hair weft in an oven for drying.

Step 406, repeating step 405 three times to obtain the second hair weft.

Step 5, preparing the hair weft: cutting the first hair weft and the second hair weft, and affixing the second hair weft flush to a bottom of the first hair weft.

Specifically, the implementation steps of step 5 include:

Step 501, cutting the first hair weft and the second hair weft to production specifications.

Step 502, affixing the second hair weft flush to the bottom of the first hair weft to obtain the hair weft.

In step 502, the first hair weft and the second hair weft are placed vertically, and then the roots of the two hair wefts are affixed together by an adhesive.

Step 6, cleaning treatment: soaking the hair weft in an alkaline solution, and soaking the hair weft in a softener.

Specifically, the implementation steps of step 6 include:

Step 601, putting 100 g of the hair weft into 1 kg of 40° C. water, adding 2 g to 3 g of sodium hypochlorite solution, and soaking for 5 minutes.

Step 602: cleaning the hair weft for three times using 40° C. water.

Step 603: after the cleaning, putting the hair weft into 1 kg of 50° C. water, adding 30 g of softener, and soaking for 10 minutes.

Step 604: after the cleaning, putting the hair weft into 1 kg of 50° C. water, adding 40 g of softener, and soaking for 10 minutes.

The purpose of step 601 to step 604 is to make the product softer and smoother and eliminate static electricity.

After step 6, step 7 of drying treatment and packaging treatment is further implemented for easy storage.

Specifically, the implementation steps of step 7 include:

Step 701, after the soaking, putting the hair weft into a centrifuge for dewatering and shaking, combing the hair weft through a dense-toothed comb, scraping off floating hairs on the hair weft, putting the hair weft into the water to be slightly wetted, unfolding and flatly laying the hair weft onto an iron plate, scraping off excess water through a brush, and putting the hair weft into a drying room at 50° C. for drying.

Step 702, finishing and packaging: after drying, ironing, combing, and folding into wefts, bundling and packaging the hair weft.

The appearance of the hair weft prepared by this process is similar to the wearer's own hair, and there is no weft edge in the conventional sense of the traditional hair weft, which solves the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

It is to be noted that the hair weft product made by the present disclosure can be worn by sewing/pasting clips to make a clip hair product, or it can be worn by pasting a double-sided adhesive on the second hair weft and cutting.

Referring to FIGS. 4 to 16D of the drawings, a hair weft according a preferred embodiment of the present invention is illustrated, wherein the hair weft comprises a first hair weft unit 30 and a second hair weft unit 40 which is attached to the first hair weft unit 30 to increase a total hair volume of the hair weft.

More specifically, as shown in FIGS. 5A to 6B, the first hair weft unit 30 comprises a hair transplantation base 31 and a first hair strand 32 which is transplanted on the hair transplantation base 31. The first hair strand 32 comprises a plurality of first hair elements 321 each is fixed to the hair transplantation base 31. The material of the first hair elements 321 can be but not limited to real human hair, synthetic fiber, blended materials and animal hair. The first hair elements 321 made from real human hair can offer the most natural look and feel, and can be styled, dyed, and treated like natural hair. Artificial fibers, such as heat-resistant or low-temperature fibers, can be used for preparing the first hair elements 321 as then may not look as natural as human hair. The blended materials combine human hair with synthetic fibers to provide a balance between natural appearance and affordability. This mix aims to offer both the realistic look of human hair and the durability of synthetic fibers. The first hair elements 321 also may be made from hair of animals like horses or yak, so as to offer a natural texture.

The hair transplantation base 31 comprises a silk mesh 311 and a glue layer 312 applied to the silk mesh 311, the glue material of the glue layer 312 is filled into the mesh holes of the silk mesh 311, so that the hair transplantation base 31 is an integral rigid and smooth layer which is suitable for the hair transplantation process.

The material of the silk mesh 311 can be natural silk, synthetic silk, mesh or netting. The natural silk is lightweight and provides a very natural appearance, making the hair look as if it's growing directly from the scalp. Synthetic silk can be used to reduce costs or increase durability. Nylon mesh is one of the most common materials used for netting. It's inexpensive and durable, lightweight, and breathable. Polyester mesh is also commonly used. It offers good durability and elasticity while maintaining high breathability. Alternatively, mesh caps incorporate a small amount of elastic fibers to increase elasticity and comfort, making the hair extension fit more snugly to the head.

In this embodiment, the silk mesh 311 can be made of Korean Silk which is a high-quality silk base material often made from synthetic silk or specially designed fibers that mimic the texture and appearance of natural silk. Korean silk is known for its fine, soft texture and natural look, providing a scalp-like appearance, making the hair look as if it is growing from the scalp. It also offers good breathability and is commonly used in high-end hair extensions.

The glue layer 312 may comprise one or more of acrylic resin, epoxy resin, polyurethane, plasticizers such as phthalates, fillers such as calcium carbonate, and solvents such as ethyl acetate, ethanol.

The first hair strand 32 comprises a first root portion 322 and a first hair strand body 323, the first root portion 322 of the first hair stand 32 is penetrated through the hair transplantation base 31 and is then fixed to a rear surface of the hair transplantation base 31 by a fixing glue, the rear surface of the hair transplantation base 31 is a binding surface 313 for adhering the first root portion 322 of the first hair strand 32. The first hair strand body 323 is extended at a front side of the hair transplantation base 31. Both of the first root portion 322 and the first hair strand body 323 are formed by the plurality of the first hair elements 321 which are aligned with each other in a strand.

The hair transplantation base 31 is correspondingly formed with a plurality of transplantation holes 314 when the first root portion 322 of the first hair stand 32 is passing through the glue layer 312 of the hair transplantation base 31. The first root portion 322 and the first strand body 323 are extended at two opposite sides of the hair transplantation base 31.

Figure 10:
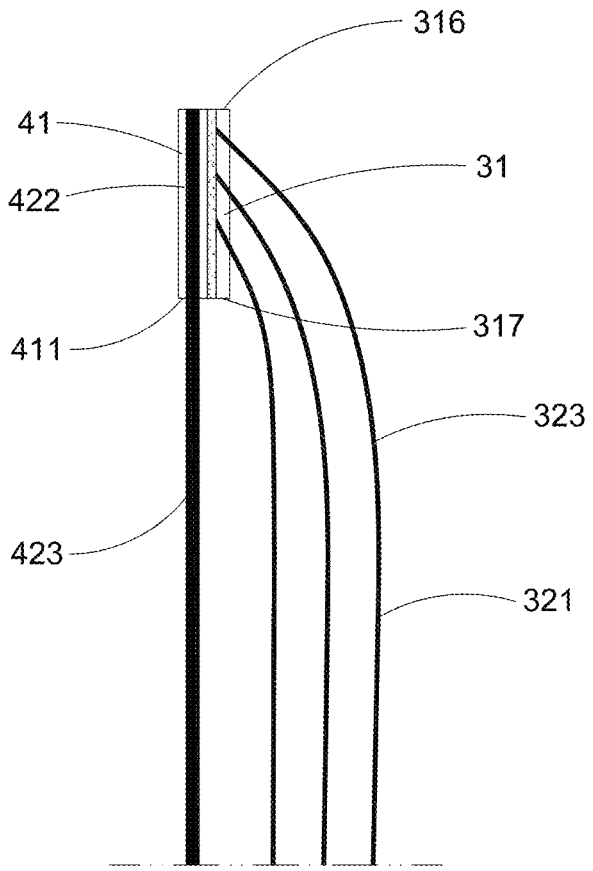
FIG. 10 is a sectional view illustrating the hair weft according to the above preferred embodiment of the present invention.

A top end of the first hair stand body 323 is planted on a front surface 315 of the hair transplantation base 31, and a top row of first hair elements 321 of the plurality of first hair elements 321 can be extended from a position on the front surface 315 adjacent to a top edge 316 of the hair transplantation base 31, as shown in FIG. 10, so that more first hair elements 321 are planted on the hair transplantation base 31.

Figure 7A:
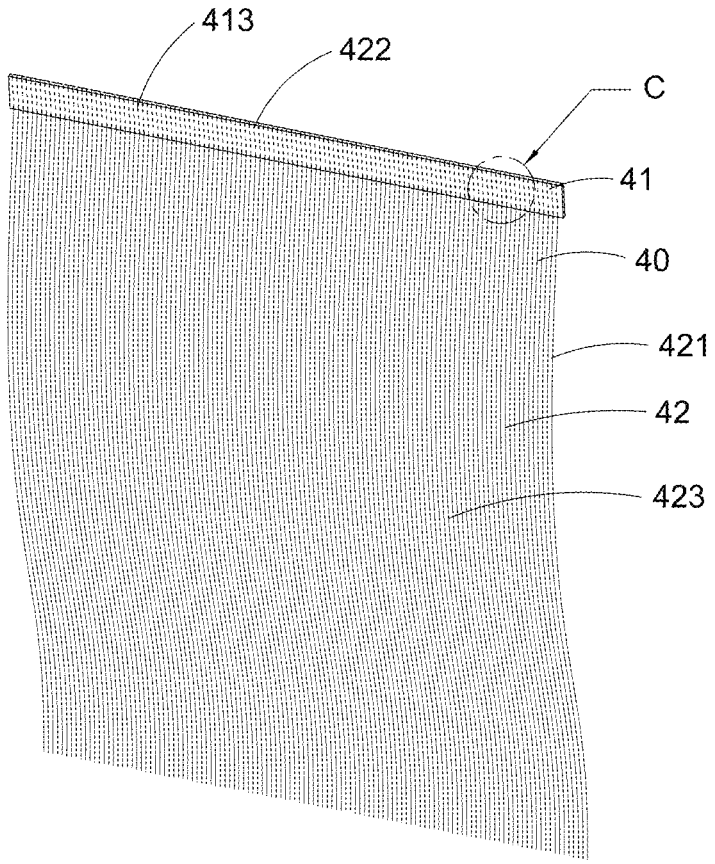
FIG. 7A is a perspective view illustrating a rear side of the first hair weft unit of the hair weft according to the above preferred embodiment of the present invention.
Figure 7B:
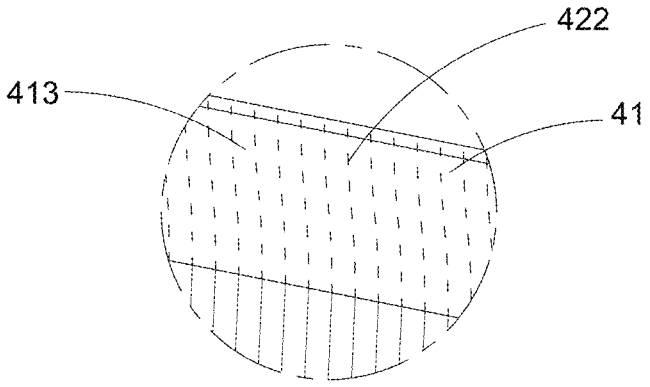
FIG. 7B is an partial enlarged view of area C in FIG. 5A.

Referring to FIGS. 7A and 7B, the second hair weft unit 40 comprises an attaching base 41 and a second hair strand 42 fixed to the attaching base 41. The attaching base 41 is adhered to the rear binding surface 313 of the hair transplantation base 31 by a binding glue, so as to fix and mount the second hair weft unit 40 to the first hair weft unit 30.

According to this embodiment, the attaching base 41 can be formed by a glue material, such as a mixture of polyurethane glue, adhesive, and thinner or diluent. Preferably, a weight content of polyurethane glue is ranged from 40%-60%, a weight content of adhesive is ranged from 10%-30%, and a weight content of thinner is ranged from 20%-40%.

The binding glue for attaching the attaching base 41 to the hair transplantation base 31 may contain one or more of epoxy resin, polyurethane, acrylic resin adhesive, phenolic resin adhesive, polyester resin adhesive, and neoprene adhesive.

Figure 16A:
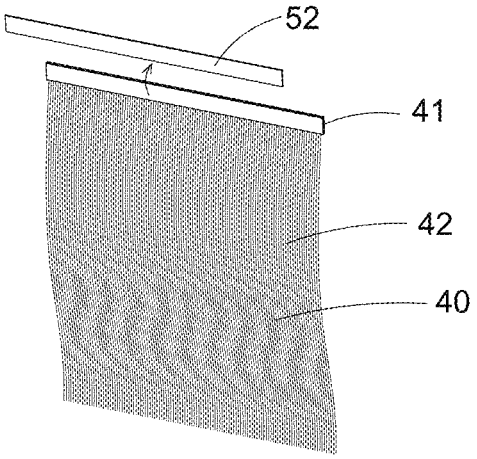
FIGS. 16A, 16B, 16C and 16D are schematic views illustrating the preparing of the hair weft by attaching the first hair weft unit to the second hair weft unit according to another alternative mode of the above preferred embodiment of the present invention.
Figure 16B:
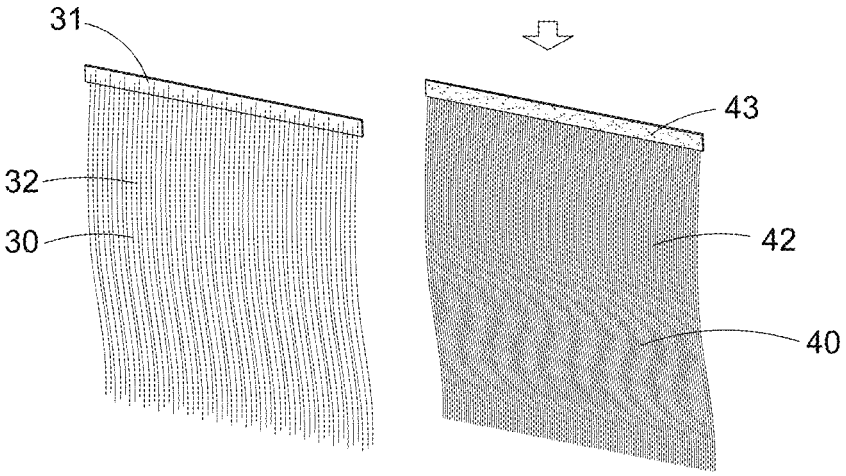
Figure 16C:
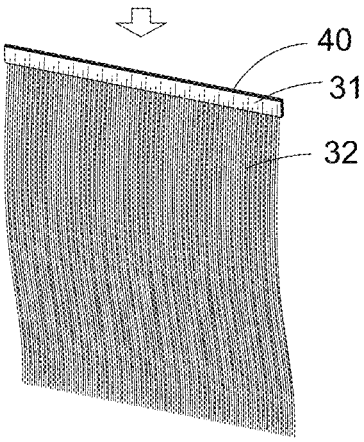
Figure 16D:
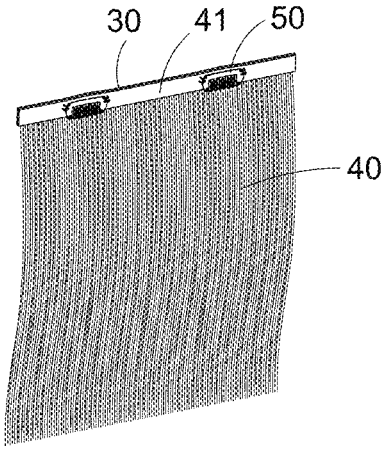

Alternatively, as another alternative mode, with reference to FIG. 16B, the attaching base 41 may be attached to the hair transplantation base 31 by a double-sided tape 43. In other words, the attaching base 41 and the hair transplantation base 31 can be adhered to two opposite sides of the double-sided tape 43.

The second hair strand 42 comprises a plurality of second hair elements 421, and the material of the second hair elements 421 can be but not limited to real human hair, synthetic fiber, blended materials and animal hair. The second hair strand 42 also comprise a second root portion 422 and a second hair strand body 423 integrally extended from the second root portion 422, the plurality of second hair elements 421 are arranged in rows to form the second root portion 422 and the second hair strand body 423.

In this embodiment, the second root portion 422 of the second hair strand 42 is embedded in the attaching base 41. During the preparing process of the second hair weft unit 40, run two or more rows of stitching 424 along the second root portion 422 of the second hair strand 42 using a sewing machine to obtain a secured preparatory hair weft, and then the glue material of the mixture of polyurethane glue, adhesive, and thinner is applied to the second root portion 422 of the second hair strand 42, and dried to form the attaching base 41 which is embedded with the second root portion 422 of the plurality of second hair elements 421. In this embodiment, the attaching base 41 is shaped and sized to couple with the hair transplantation base 31, so as to form an integral base for supporting the first hair strand 32 and the second hair strand 42. As shown in FIG. 10 of the drawings, the first hair strand body 323 of the first hair strand 32 and the second hair strand body 423 of the second hair strand 42 are provided at two opposite sides of the hair transplantation base 31, so that the two hair weft units are combined to result in a final product that meets a high volume requirement. Gluing the hair transplantation base 31 between the two hair strands ensures a strong bond and seamless integration of the two hair weft units, creating a cohesive and natural-looking final product.

More specifically, the first hair strand body 323 of the first hair strand 32 is extended from the front surface 315 of the hair transplantation base 31, and a top end of the second hair strand body 423 of the second hair strand 42 is extended from a bottom edge 411 of the attaching base 411 and is preferred to be extending from a position corresponding to a bottom edge 317 of the hair transplantation base 31.

According to this embodiment, a top row of the first hair elements 321 of the first hair strand body 323 is extended from the top edge 316 of the hair transplantation base 31 and is naturally draping over the hair transplantation base 31 in a curved manner, the second hair strand body 423 is straightly extended from the bottom edge of the hair transplantation base 31, the starting points of their extensions are different, with the more curled first hair strand body 323 overlaying the second hair strand 42, a sense of depth and layering is created, so as to enhance the overall realism of the transplanted hair and improve texture, making the transplanted hair look more voluminous and lifelike. In other words, the two hair strand bodies provide varying textures and layers, this visual depth and texture is liking the natural growth patterns of hair, making the hair weft look more authentic and appealing.

In addition, the first hair strand 32 has a lower density while the second hair strand 42 can be configured to have a higher density. In other words, in a same designated area corresponding to an area in the hair transplantation base 31, the number of the first hair elements 321 is smaller than the number of the second hair elements 421, so that the varying densities of the two hair strands contribute to a more pronounced layered effect, further mimicking natural hair growth.

Figure 11:
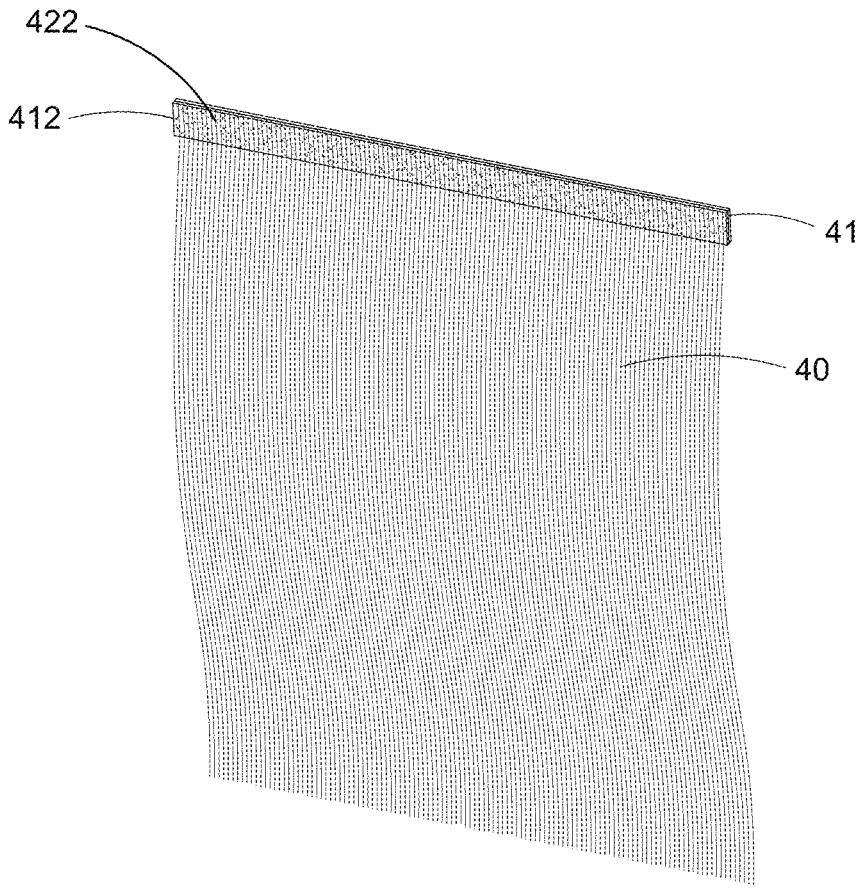
FIG. 11 is a perspective view illustrating a second hair weft unit of the hair weft according to an alternative mode of the above preferred embodiment of the present invention.
Figure 12:
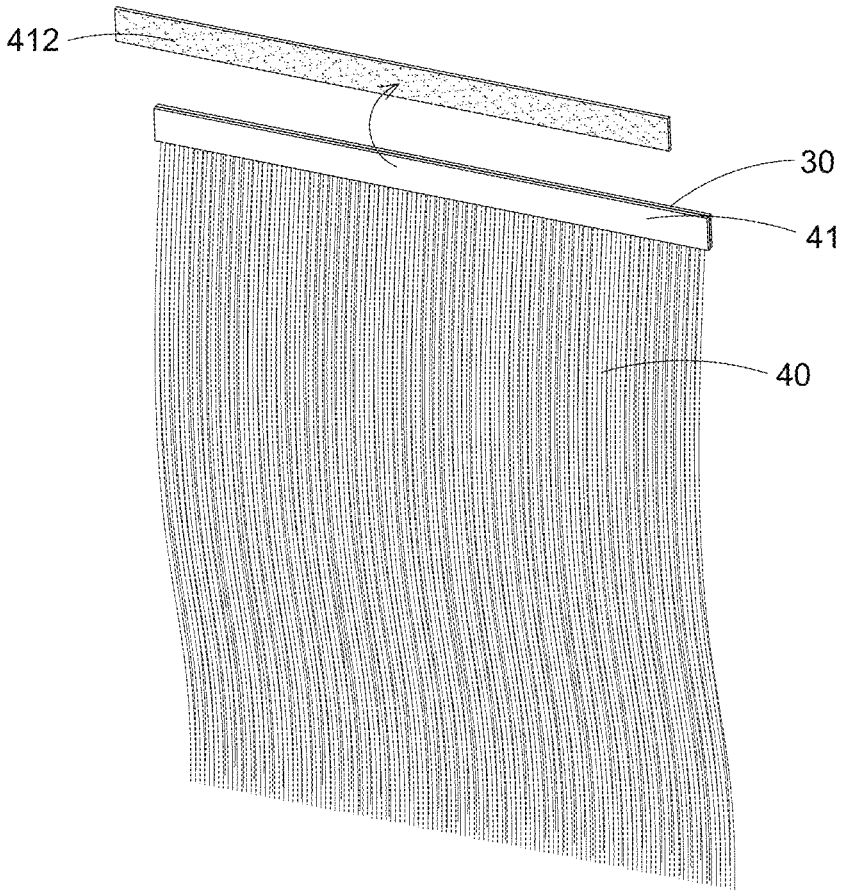
FIG. 12 is a schematic view illustrating the hair weft according to an alternative mode of the above preferred embodiment of the present invention.
Figure 13A:
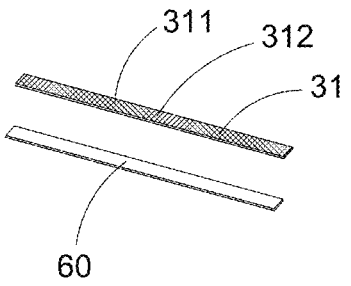
FIGS. 13A, 13B, 13C and 13D are schematic views illustrating the preparing of the first hair weft unit of the hair weft according to the above preferred embodiment of the present invention.
Figure 13B:
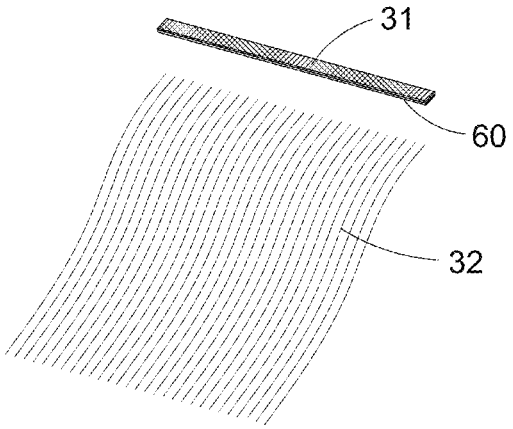
Figure 13D:
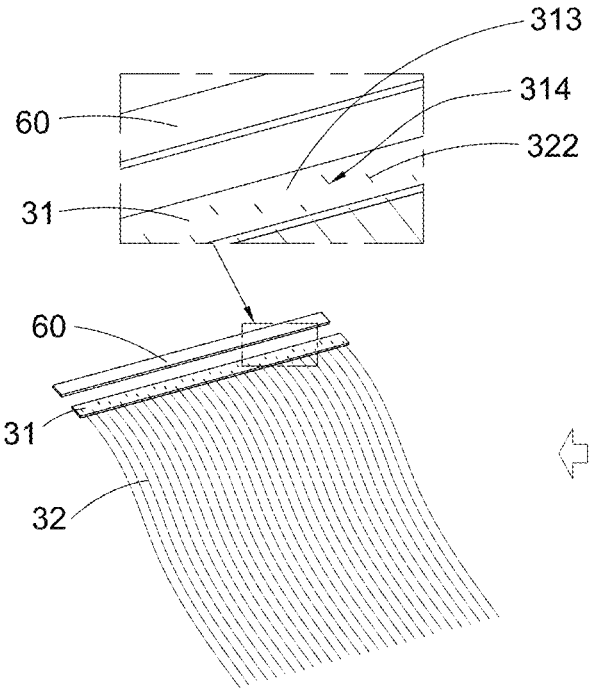
Figure 13C:
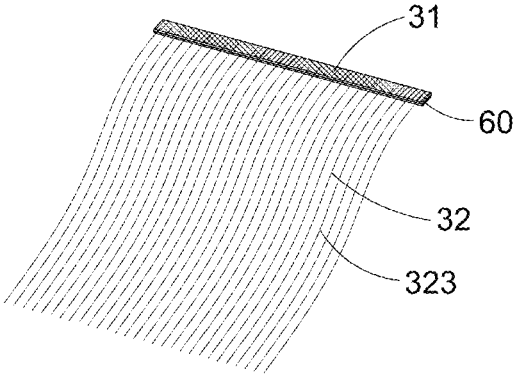
Figure 14A:
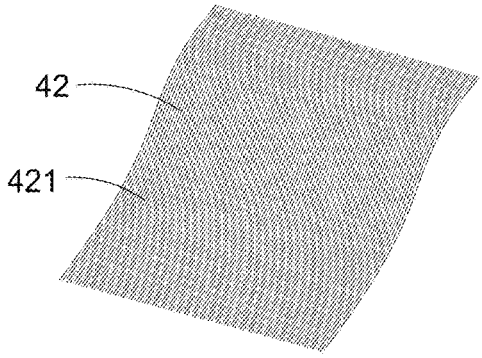
FIGS. 14A, 14B, 14C, 14D, 14E and 14F are schematic views illustrating the preparing of the second hair weft unit of the hair weft according to the above preferred embodiment of the present invention.
Figure 14B:
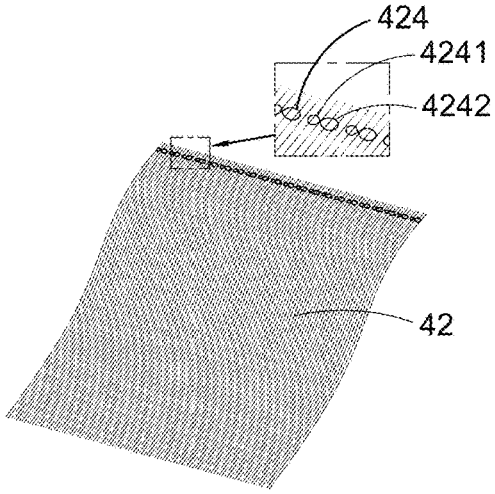
Figure 14D:
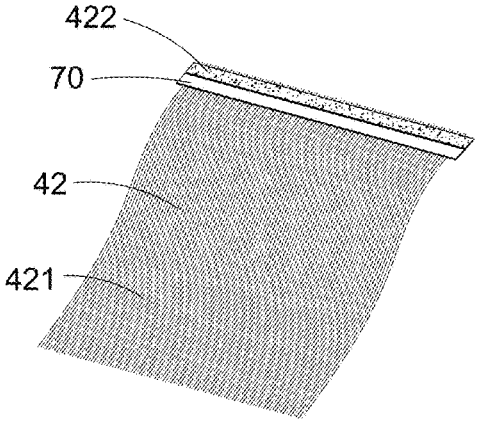
Figure 14C:
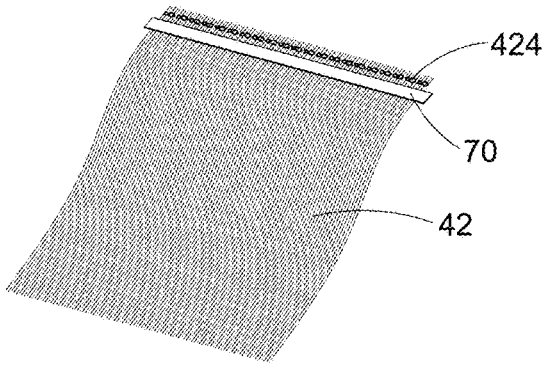
Figure 14E:
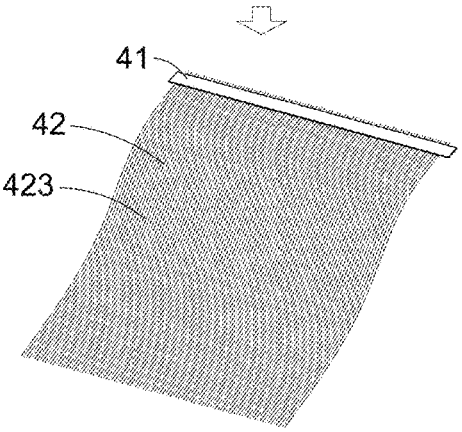
Figure 14F:
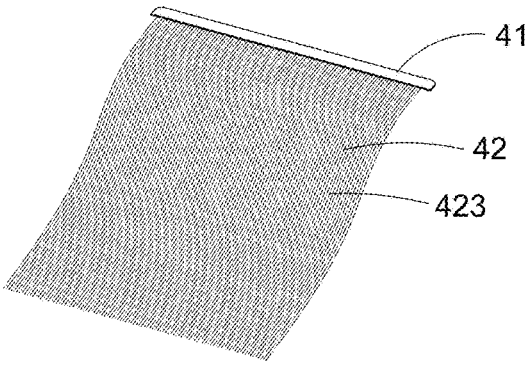
Figure 15A:
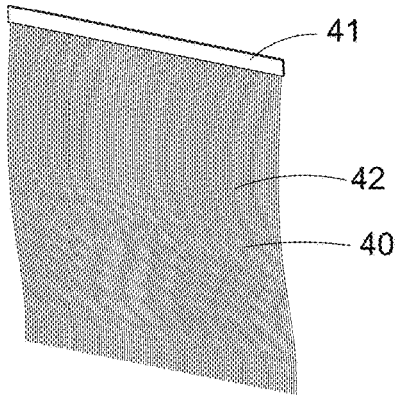
FIGS. 15A, 15B, 15C and 15D are schematic views illustrating the preparing of the hair weft by attaching the first hair weft unit to the second hair weft unit according to the above preferred embodiment of the present invention.
Figure 15B:
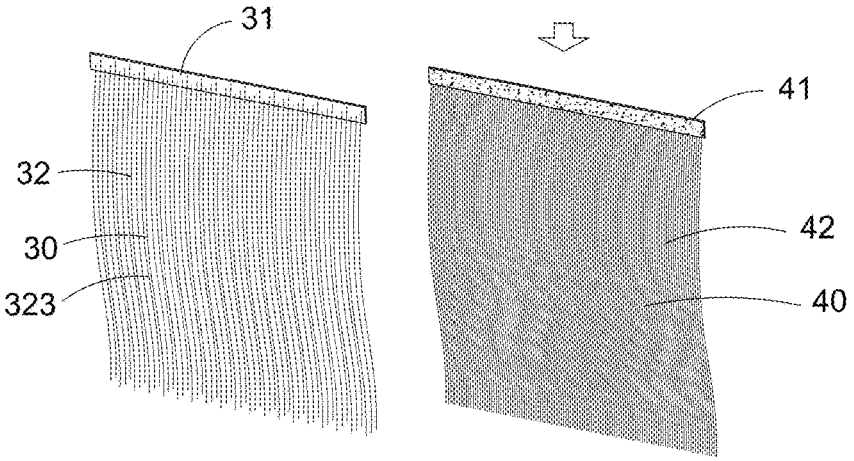
Figure 15C:
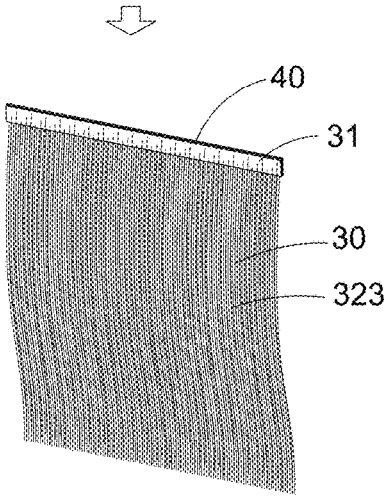
Figure 15D:
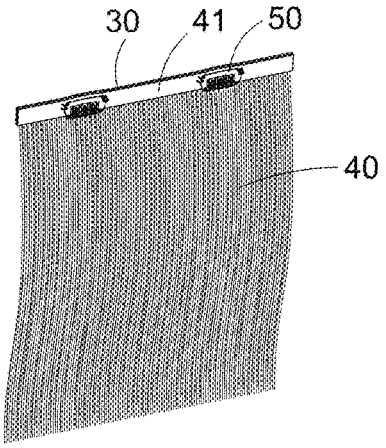

Referring to FIGS. 11 and 12 of the drawings, according to an alternative mode, the second hair weft unit 40 comprises an attaching base 41 and a second hair strand 42 fixed to the attaching base 41. The attaching base 41 in this embodiment is an adhering tape, and a second root portion 422 of the second hair strand 42 is adhered to an adhering surface 412 of the adhering tape, and the adhering tape is adhered to the rear binding surface 313 of the hair transplantation base 31 by a binding glue, so as to fix and mount the second hair weft unit 40 to the first hair weft unit 30.

The adhering tape can be a double-sided tape, so that the other side of the adhering tape which is not attached with the second hair strand 42 can be used for being adhered to the hair of the user, so as to wear the hair weft of the present invention on the user.

Referring to FIGS. 8A to 9B of the drawings, the hair weft further comprises an attaching unit 50 which is coupled to a rear side of the attaching base 41 of the second hair weft unit 40 for coupling the hair weft to the hair of the user. Accordingly, the attaching base 41 has a front surface 413 that is adhered to the hair transplantation base 31, and a rear surface 414 for mounting the attaching unit 50.

In this embodiment, the attaching unit 50 comprises a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the hair transplantation base 31 and the attaching base 41, as well as the corresponding fixing holes 5111 for connecting the fixing base 511 to the first hair weft unit 30 and the second hair weft unit 40.

Figure 8A:
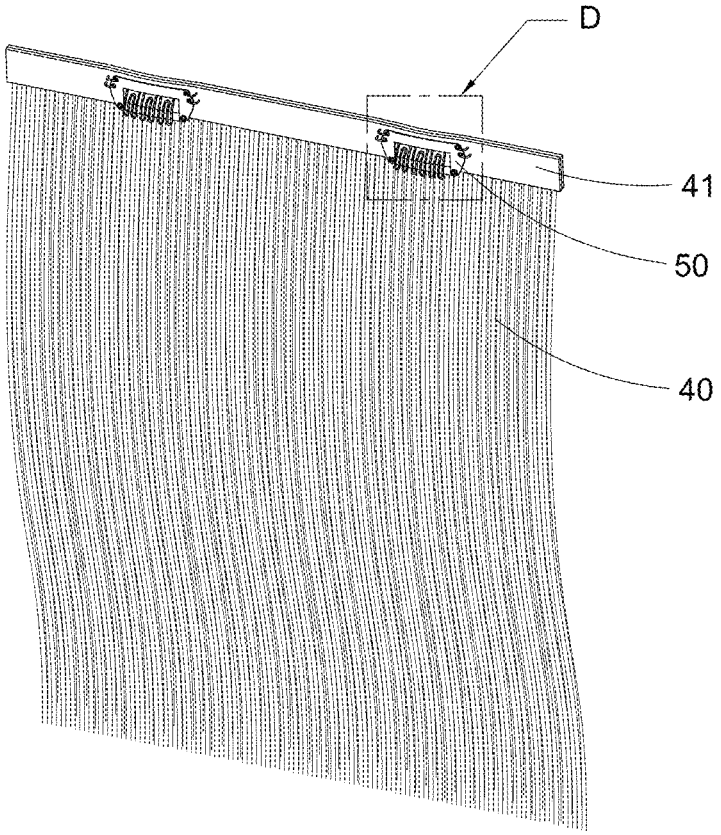
FIG. 8A is a perspective view illustrating a rear side of the hair weft according to the above preferred embodiment of the present invention, wherein a clipping element is in an open state.
Figure 8B:
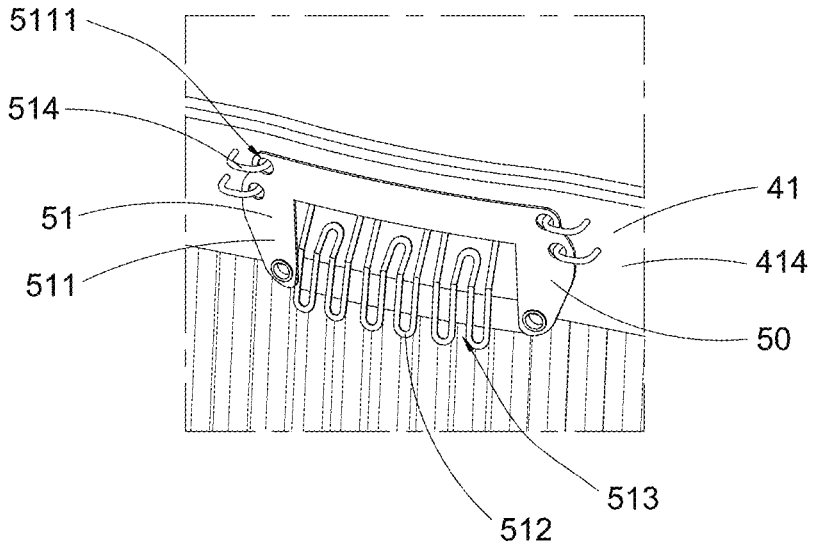
FIG. 8B is an partial enlarged view of area D in FIG. 8A.
Figure 9A:
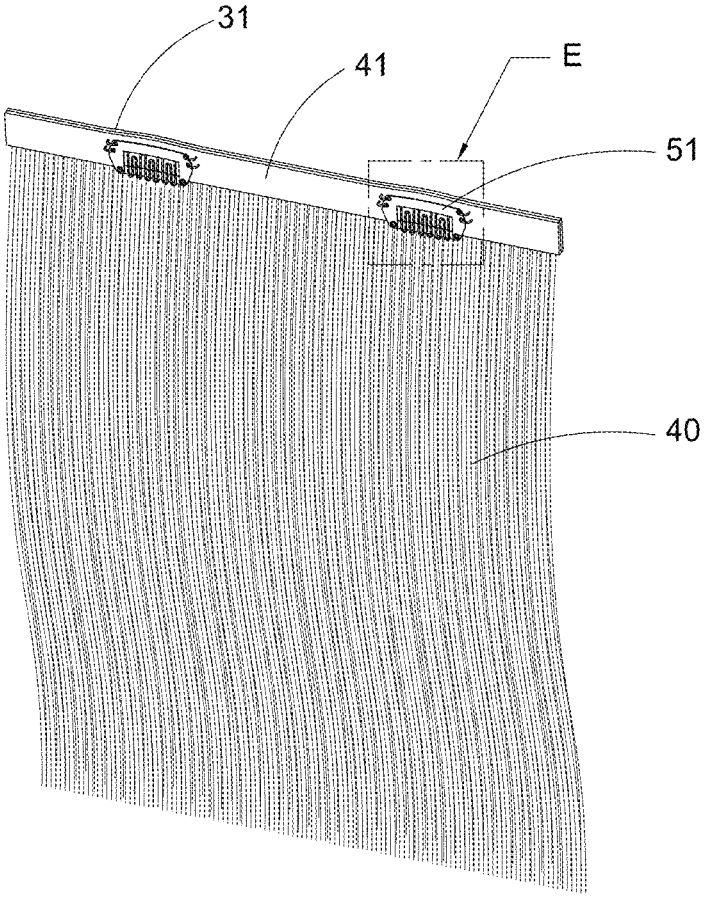
FIG. 9A is a perspective view illustrating the clipping element of the hair weft being in a closed state according to the above preferred embodiment of the present invention.
Figure 9B:
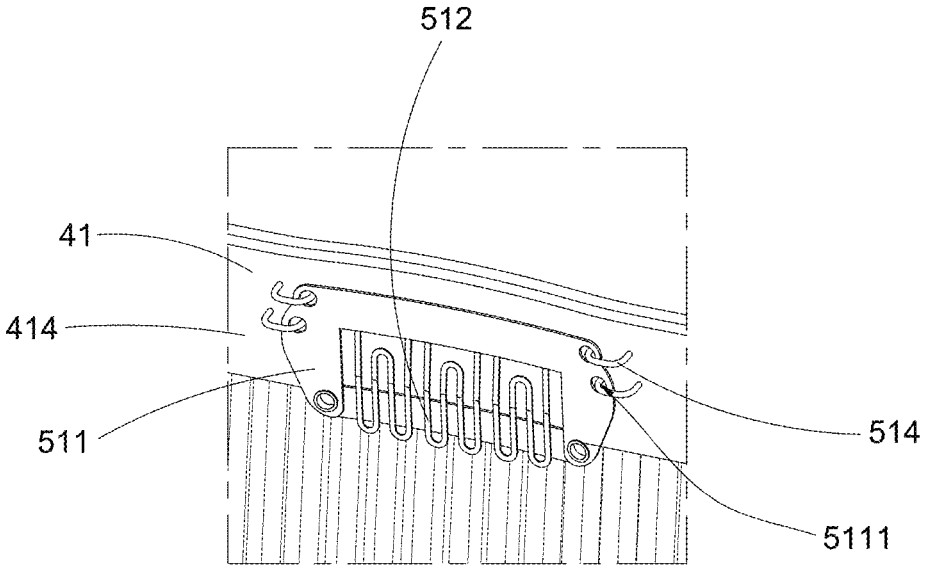
FIG. 9B is an partial enlarged view of area E in FIG. 9A.

As shown in FIGS. 8B and 9B of the drawings, the fixing base 511 has two sets of fixing holes 5111 at two end portions thereof, and the clipping element 51 comprises two connecting strings 514 mounted to each of the two sets of fixing holes 5111 respectively.

The fixing base 511 is made of a resilient material, and in a closed state, the clipping member 512 is attached to the fixing base 511. When in a use state, the two end portions of the fixing base 511 can be pressed to deform the fixing base 511, so that the clipping member 512 is spaced apart from the fixing base 511 to define the clipping groove 513.

When the hair weft of the present invention is worn on the head of the user, the attaching unit 50 is attached to the head of the user, the second weft unit 40 is provided under the first weft unit 30 and is more close to the scalp, so that by replicating the natural decrease in hair density from the scalp outwards, the hair weft of the present invention achieves a more authentic and lifelike look. The higher density of the second hair strand 42 positioned nearer the scalp creates a fuller and more secure attachment, potentially improving comfort and preventing slippage.

Referring to FIGS. 16A to 16D of the drawings, as an alternative mode, the hair weft further comprises an attaching unit 50 which is coupled to a rear side of the attaching base 41 of the second hair weft unit 40 for coupling the hair weft to the hair of the user. In this embodiment, the attaching unit 50 comprises a double-sided binding tape 52, one side of the double-sided binding tape 52 is attached to the rear surface 414 of the attaching base 41, the other side of the double-sided binding tape 52 is used for adhering the hair of the user during usage.

The person of ordinary skilled in the art should understand that in alternative modes, the the hair weft may comprises two first hair weft units 30, the hair transplantation bases 31 of the two first hair weft units 30 are attached with each other, so as to form two layers of hair strands. The attaching unit 50 which may be the double-sided binding tape 52 can be attached to one of the first hair weft units 30 for mounting the hair weft to the hair of the user.

In another alternative mode, the hair weft may comprises the first hair weft unit 30 and the second hair weft unit 40, and the second hair weft unit 40 can be mounted to the front surface 315 of the first hair weft unit 30, and an upper portion of the first hair strand body 322 is sandwiched between the hair transplantation base 31 of the first hair weft unit 30 and the attaching base 41 of the second hair weft unit 40.

Referring to FIGS. 13A to 15D of the drawings, a preparing method of the hair weft according to the preferred embodiment of the present invention is illustrated, the preparing method comprises a process of preparing the first hair weft unit 30, a process of preparing the second hair weft unit 40, a process of attaching the second hair weft unit 40 to the first hair weft unit 30, a process of cleaning the hair weft unit, and a process of mounting the attaching unit 50 to the second hair weft unit 40.

The process of preparing the first hair weft unit 30 comprises a step of mounting a support piece 60 with the hair transplantation base 31, and a step of transplanting the first hair strand 32 on the hair transplantation base 31.

More specifically, referring to FIGS. 13A to 13D, the support piece 60 with a marked transplantation area is aligned with the hair transplantation base 31, the support piece 60 is shaped and sized to couple with the hair transplantation base 31 and then is fixed with the hair transplantation base 31. For example, a stapler can be used to fix the support piece 60 with the hair transplantation base 31. The hair transplantation base 31 is prepared by applying the glue layer 312 on the silk mesh 311.

When transplanting the first hair strand 32 on the hair transplantation base 31, a middle part of the material of the first hair strand 32 is fixed by two clamping plates each is provided with a curved pin, and then the material of the first hair strand 32 is placed in a transplantation area of a transplantation machine, the combination of the support piece 60 and the hair transplantation base 31 is placed on the first hair strand 32 in a manner that the hair transplantation base 31 is sandwiched between the support piece 60 and the hair transplantation base 31.

The transplantation machine is then in operation to drive needle hooks to guide the material of the first hair strand 32 to pass through the hair transplantation base 31 and the support piece 60. And then the portion of the material of the first hair strand 32 disposed between the support piece 60 and the hair transplantation base 31 is cut to leave a first root portion 322 of the first hair strand 32 on the rear binding surface 313 of the hair transplantation base 31. The support piece 60 is thus separated from the hair transplantation base 31. The length of the first root portion 322 is preferred to be ranged from 0.1 cm-2 cm. Finally, a fixing glue is applied to the first root portion 322 of the first hair strand 32 to the rear binding surface 313 of the hair transplantation base 31.

The support piece 60 can be a natural leather layer or a PVC artificial leather layer. In this embodiment, the support piece 60 is made of PVC artificial leather and has a thickness of 0.4 mm. After the needle hooks of the transplantation machine pierce the support piece 60 and the glue layer 312 of the hair transplantation base 31 in turn when the needle hooks move up and down, the material of the first hair elements 321 of the first hair strand 32 is guided to be out of the pierced transplantation holes 314, and the resilient support piece 60 shrinks after the needle has been withdrawn from the transplantation holes 314, so as to clamp and retain the first hair strand 32 in position.

Referring to FIGS. 14A to 14F, the process of preparing the second hair weft unit 40 comprises the steps of stitching a top of the second hair strand 42 to obtain a fixed preparatory hair weft unit, applying a masking tape 70 which is 1.2 inches to 1.5 inches from a top of the preparatory hair weft unit to define the second root portion 422 of the second hair strand 42, and applying a glue material on the second root portion 422 of the second hair strand 42 to form the attaching base 41 which is embedded with the second root portion 422 of the second hair strand 42.

Accordingly, the stitching 424 of the two quilting lines is formed on the second root portion 422 of the second hair strand 42 through a double-needle sewing machine. In this embodiment, the second hair weft unit 40 comprises a first stitching line 4241 and a second stitching line 4242, the two intersecting stitching lines 4241 and 4242 are arranged in an "8" pattern. The first stitching line 4241 is made of a water-soluble thread, and the second stitching line 4242 is a cotton thread. When exposed to the liquid glue material, the water-soluble thread of the first stitching line 4241 dissolves, causing the cotton thread of the second stitching line 4242 to detach. The purpose of these two stitching liens 4241 and 4242 is to keep the material of the second hair strand 42 of the second hair weft unit 40 be flat and stable when placed on a glass surface for applying the glue material, preventing it from shifting or moving around.

The masking tape 70 is arranged to define the second root portion 422 and the second hair strand body 423 of the second hair strand 42 by preventing the glue material applied on the second root portion 422 to flow towards the second hair strand body 423 of the second hair strand 42.

The glue material can be a mixture of polyurethane glue, adhesive, and thinner or diluent. The preparation of the glue material comprises a step of mixing polyurethane glue, adhesive, and thinner, wherein a weight content of polyurethane glue is ranged from 40%-60%, a weight content of adhesive is ranged from 10%-30%, and a weight content of thinner is ranged from 20%-40%.

Referring to FIGS. 15A to 15D, in the process of attaching the second hair weft unit 40 to the first hair weft unit 30, the binding glue is applied between the attaching base 41 and the hair transplantation base 31, so as to for the hair weft comprising the first hair weft unit 30 and the second hair weft unit 40. The binding glue is made of one or more of epoxy resin, polyurethane, acrylic resin adhesive, phenolic resin adhesive, polyester resin adhesive, and neoprene adhesive.

Alternatively, the attaching base 41 and the hair transplantation base 31 are respectively adhered to two opposite sides of a double-sided tape, so as to assembly the first weft unit 30 with the second weft unit 401.

In the process of cleaning the hair weft unit comprising the first weft unit 30 and the second weft unit 40, 100 g of the hair weft is added into 1 kg of 40° C. water, 2 g to 3 g of sodium hypochlorite solution is added into the water, and soak for 5 minutes; and then clean the hair weft for three times using 40° C. water.; after the cleaning, the hair weft is put into 1 kg of 50° C. water, 30 g of softener is added, and soak for 10 minutes; after the previously cleaning step, the hair weft is put into 1 kg of 50° C. water, 40 g of softener is added, and soak for 10 minutes, so as to make the product softer and smoother and eliminate static electricity.

After the above cleaning step with the water, a drying treatment is further implemented for easy storage. More specifically, after the soaking, the hair weft is put into a centrifuge for dewatering and shaking, the hair weft is combined through a dense-toothed comb to scrape off floating hairs on the hair weft, the hair weft is then put into the water to be slightly wetted, unfold and flatly lay the hair weft onto an iron plate, scrape off excess water through a brush, and then the hair weft is put into a drying room at 50° C. for drying.

In the process of mounting the attaching unit 50, the attaching unit 50 which can be embodied as a clipping element 51 is attached to the rear surface 414 of the attaching base 41 of the second weft unit 40 by the connecting strings 514 which are respectively penetrating through the attaching base 41 and the hair transplantation base 31.

As an alternative mode, a double-sided binding tape 5 is used as the attaching unit 50, one side of the double-sided binding tape 52 is attached to the rear surface 414 of the attaching base 41, the other side of the double-sided binding tape 52 is used for adhering the hair of the user during usage.

Figure 17:
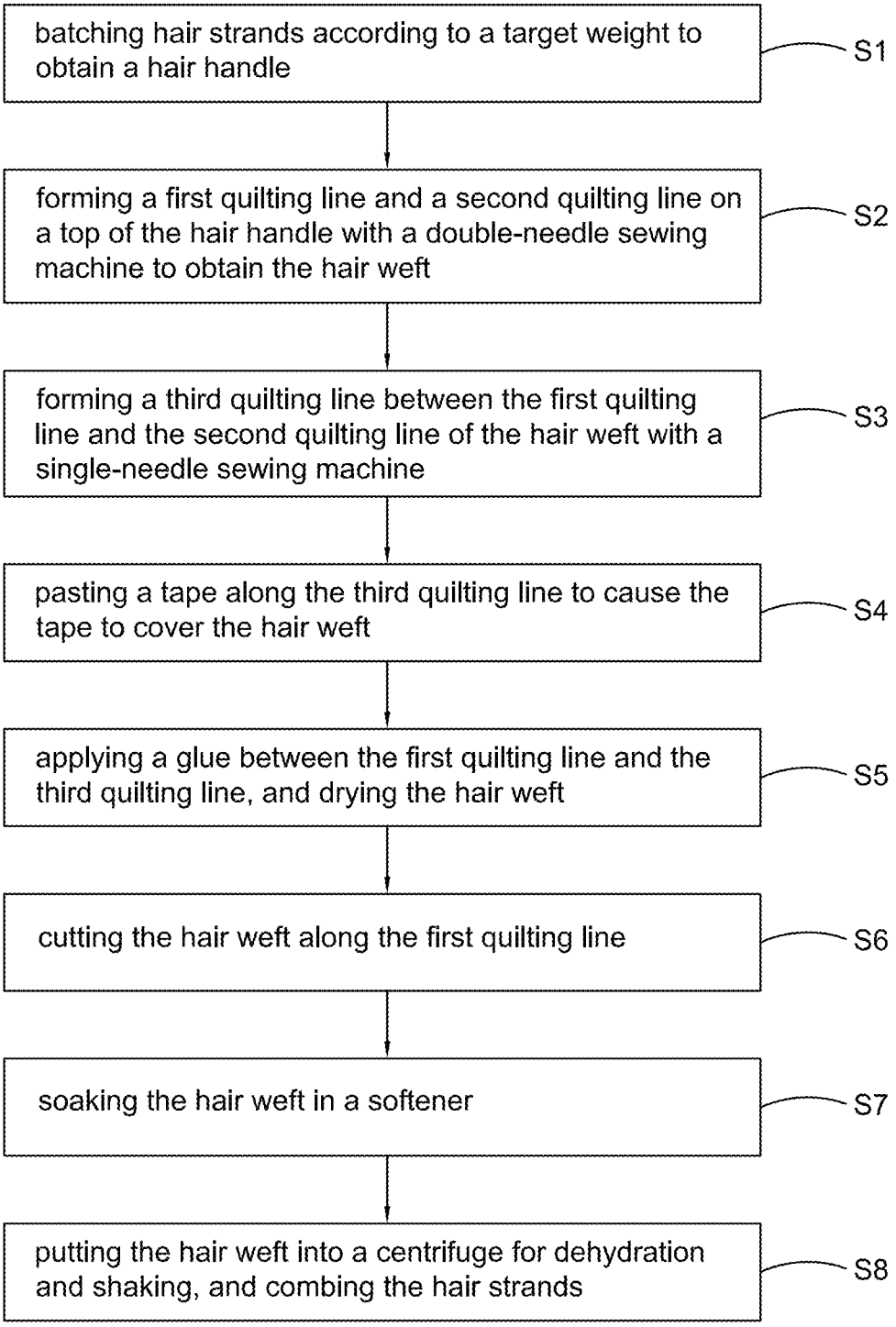
FIG. 17 is a flowchart of a preparation process of a hair weft according to another embodiment of the present invention.
Figure 18:
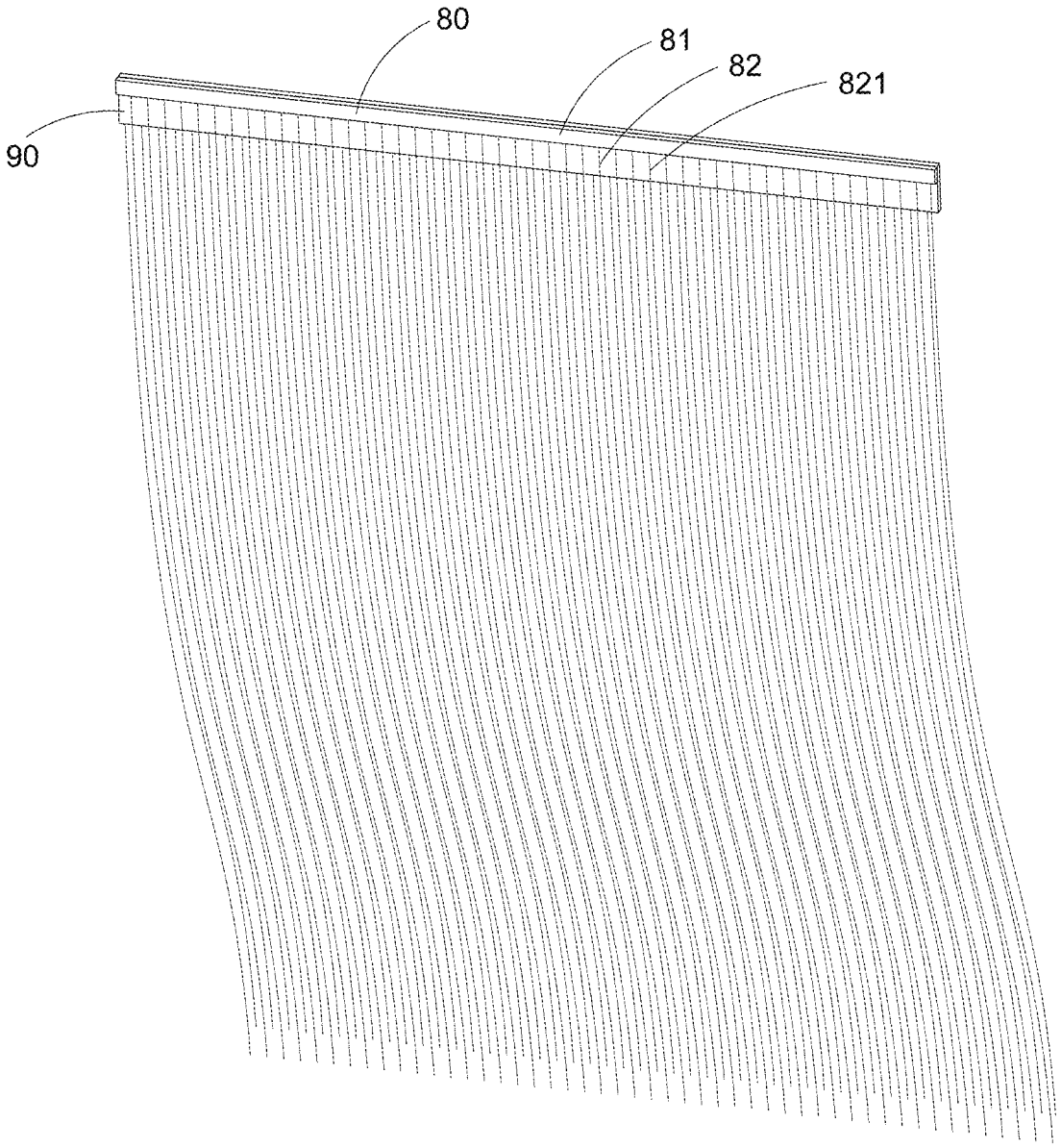
FIG. 18 is a perspective view of a hair weft according to another preferred embodiment of the present invention.

As shown in FIG. 17, a preparation method of a hair weft provided by the present disclosure includes the following steps, which are illustrated at blocks.

At block S1: batching hair strands according to a target weight to obtain a hair handle. In some embodiments, a 100 g weight of hair strands is taken as an example for making the hair handle.

At block S2: forming a first quilting line and a second quilting line on a top of the hair handle with a double-needle sewing machine to obtain the hair weft. Specifically, the first quilting line is a cotton sewing thread and the second quilting line is a water-soluble sewing thread. The double-needle sewing machine has a gauge of 30-35 stitches per inch, and a spacing between the first quilting line and the second quilting line is 3-4 mm. In this way, the hair weft may be secured for subsequent production.

At block S3: forming a third quilting line between the first quilting line and the second quilting line of the hair weft with a single-needle sewing machine. Specifically, the third quilting line is a cotton sewing thread, and a spacing between the third quilting line and the first quilting line is 1 mm. Since there are two cotton sewing threads, namely, the first quilting line and the third quilting line, and the spacing therebetween is only 1 millimeter, the hair weft may not have problems such as discomfort of wearing and poor breathability caused by the weft edge being too thick and too hard.

At block S4: pasting a tape along the third quilting line to cause the tape to cover the hair weft. Specifically, a textured paper tape is pasted along the third quilting line made of cotton, such that the textured paper tape covers the hair strands, thereby preventing a glue from penetrating into the interior of the hair strands during the step of applying the glue, and shaping the hair weft.

At block S5: applying a glue between the first quilting line and the third quilting line, and drying the hair weft.

At block S6: cutting the hair weft along the first quilting line. Specifically, the protruding excess hair strands are cut off along the first quilting line made of cotton, retaining only 1 mm of hair strands above the third quilting line, which can make the weft edge of the hair weft invisible when wearing the hair weft, and the hair weft is stable while not being affected by the sewing threads.

At block S7: removing the textured paper tape and soaking the hair weft in a softener. Since the second quilting line is a water-soluble sewing thread, the second quilting line will dissolve and disappear when the hair weft is soaked.

At block S8: putting the hair weft into a centrifuge for dehydration and shaking, and combing the hair strands.

In step S5, the glue may be a mixture of a polycarbonate glue, an adhesive, and a diluent. In some embodiments, the step S5 comprises the following steps:

Step S51: applying a first glue between the first quilting line and the third quilting line on a front side of the hair weft, and drying the hair weft at a drying temperature of 45-50° C. for 15 minutes;

Step S52: applying a second glue between the first quilting line and the third quilting line on the front side of the hair weft, and drying the hair weft at a drying temperature of 45-50° C. for 15 minutes;

Step S53: applying a third glue between the first quilting line and the third quilting line on the front side of the hair weft, and drying the hair weft at a drying temperature of 45-50° C. for 120 minutes;

Step S54: applying a fourth glue between the first quilting line and the third quilting line on a back side of the hair weft, and drying the hair weft at a drying temperature of 45-50° C. for 15 minutes;

Step S55: applying a fifth glue between the first quilting line and the third quilting line at the back side of the hair weft, and drying the hair weft at a drying temperature of 45-50° C. for 15 minutes;

Step S56: applying a sixth glue between the first quilting line and the third quilting line on the back side of the hair weft, and drying the hair weft at a drying temperature of 45-50° C. for 240 minutes.

The glue is repeatedly scraped using a scraper each time the glue is applied, such that the glue is in uniform contact with the hair strands and serves to fix the hair strands.

In some embodiments, the step S7 comprises the following steps:

Step S71: adding 2 g-3 g of a sodium hypochlorite solution to 1 kg of water at 40° C. to obtain a first solution, and soaking the hair weft in the first solution for 5 minutes;

Step S72: washing the hair weft with water at 40° C.;

Step S73: adding 30 g of the softener to 1 kg of water at 50° C. to obtain a second solution, and soaking the hair weft in the second solution for 10 minutes;

Step S74: adding 40 g of the softener to 1 kg of water at 50° C. to obtain a third solution, and soaking the hair weft in the third solution for 10 minutes.

In some embodiments, the step S8 further comprises the steps of placing the hair weft into the third solution slightly moistened, unfolding and laying flat the hair weft, scraping out the water, and drying. Specifically, the dried hair weft is combed using a dense-toothed comb, floating hairs on the hair weft are scraped off, the hair weft is put into the third solution again to be slightly moistened and then unfolded and laid flat on an iron plate, the excess water is scraped off using a brush, and the hair weft is put into a drying room at 50° C. for drying.

It is to be understood that the hair extension may have a variety of different colors. Therefore, step S1 may further comprise the steps of dyeing the hair strands before batching, and obtaining a dyed hair handle after batching, thereby preparing a dyed hair weft.

Further, the preparation method may further comprise a step S9: ironing and combing the hair weft, stacking the hair weft, and bundling and packaging for transportation.

The present disclosure provides a preparation method of a hair weft, including: batching hair strands according to a target weight to obtain a hair handle; forming a first quilting line and a second quilting line on a top of the hair handle with a double-needle sewing machine to obtain the hair weft; forming a third quilting line between the first quilting line and the second quilting line of the hair weft with a single-needle sewing machine; pasting a tape along the third quilting line to cause the tape to cover the hair weft; applying a glue between the first quilting line and the third quilting line, and drying the hair weft; cutting the hair weft along the first quilting line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

Referring to FIG. 18 to FIG. 28 of the drawings, a hair weft according to another preferred embodiment of the present invention is illustrated. The hair weft comprises a first hair weft unit 80 and a second hair weft unit 90 attached to the first hair weft unit 80.

In this embodiment, the first hair weft unit 80 comprises a first glue base 81 and a first hair strand 82 which comprises a plurality of first hair element 821 provided on the first glue base 81. The second hair weft unit 90 comprises a second glue base 91 and a second hair strand 92 which comprises a plurality of second hair elements 921 provided on the second glue base 91.

The first glue base 81 is the base of the first hair weft unit 80, serving as the foundation where the first hair strands 82 are attached. It plays a critical role in maintaining the integrity and stability of the weft. The first hair strand 82 is composed of a plurality of the first hair elements 821, these hair elements are embedded or attached to the first glue base 81. The plurality of first hair elements 821 gives the hair strand its volume and natural flow, simulating real hair growth patterns.

Similar to the first glue base 81, the second glue base 91 serves as the base for the second hair weft unit 90. Its structure is designed to complement the first glue base 81, providing a stable foundation for bonding the two units together. The second hair strand 92 is composed of a plurality of the second hair elements 921, this strand also contributes to the overall volume and density of the hair weft. The distribution and orientation of these hair elements 821 and 921 are designed to enhance the natural look and feel of the hair.

The presence of both the first and second hair weft units 80 and 90 allows for the layering of hair strands, significantly increasing the volume of the weft compared to single-layer designs. This multi-layered structure makes the hair appear fuller, more natural, and offers better coverage. The combination of multiple hair elements 821 and 921 ensures that the hair weft can achieve superior thickness while maintaining a lightweight feel, giving users a more luxurious appearance.

Each hair weft unit features hair elements that are designed to mirror the natural flow of human hair. The staggered arrangement of the hair strands from both the first and second weft units 80 and 90 prevents the formation of unnatural gaps or bunching. Additionally, the blending of the two layers creates a seamless appearance, making it difficult to distinguish between the natural hair of the wearer and the hair weft. The result is an overall effect that enhances realism, contributing to a softer, more natural look.

By utilizing two different layers with their respective weft edges, the hair weft achieves a superior texture, combining the best properties of both layers. The double-layer system distributes the weight of the hair more evenly, preventing the weft from feeling bulky or uncomfortable on the scalp. This contributes to a smoother and more comfortable fit for the wearer, especially during extended use.

The material of the first hair elements 821 and the second hair elements 921 can be but not limited to real human hair, synthetic fiber, blended materials and animal hair. The first hair elements 821 and the second hair elements 921 made from real human hair can offer the most natural look and feel, and can be styled, dyed, and treated like natural hair. Artificial fibers, such as heat-resistant or low-temperature fibers, can be used for preparing the first hair elements 821 and the second hair elements 921 as they may look as natural as human hair. The blended materials combine human hair with synthetic fibers to provide a balance between natural appearance and affordability. This mix aims to offer both the realistic look of human hair and the durability of synthetic fibers. The first hair elements 821 and the second hair elements 921 also may be made from hair of animals like horses or yak, so as to offer a natural texture.

In this embodiment, each of the first glue base 81 and the second glue base 91 can be made of a mixture of polycarbonate glue or polyurethane glue, adhesive, and thinner or diluent. Preferably, a weight content of polycarbonate glue or polyurethane glue is ranged from 40%-60%, a weight content of adhesive is ranged from 10%-30%, and a weight content of thinner is ranged from 20%-40%.

Figure 19:
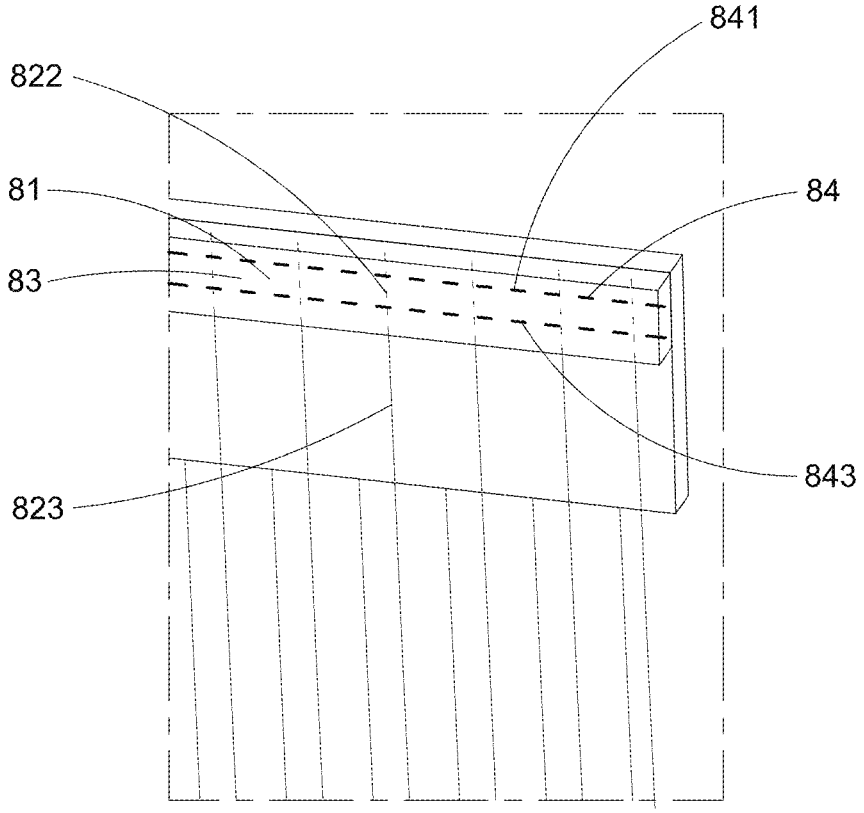
FIG. 19 is a partial enlarged view illustrating a first weft edge of the hair weft according to the above preferred embodiment of the present invention.

The first hair strand 82 comprises a first root portion 822 and a first hair strand body 823 integrally extended form the first root portion 822, the first root portion 822 is embedded into the first glue base 81 when the glue material is applied on the first hair strand 82, as shown in FIG. 19.

Figure 21:
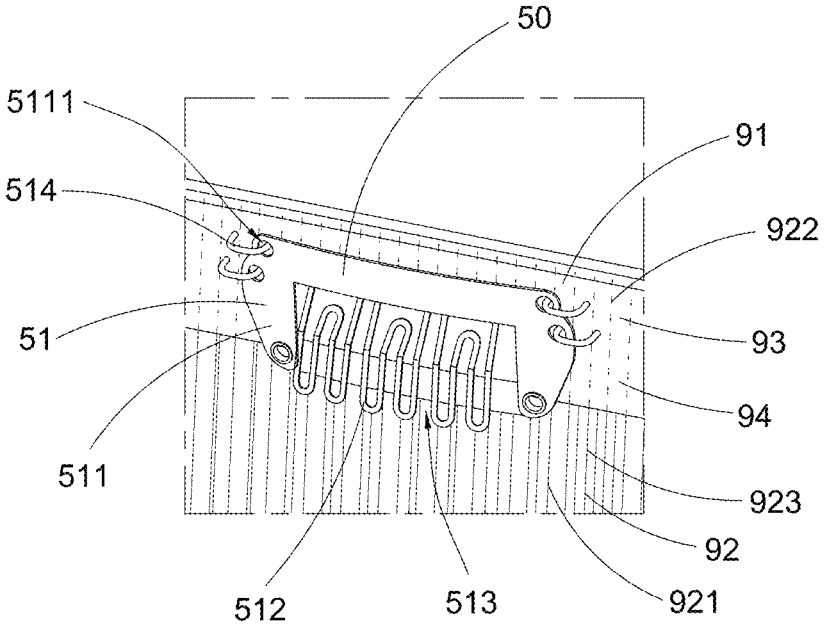
FIG. 21 is a partial enlarged view illustrating a second weft edge of the hair weft according to the above preferred embodiment of the present invention.

As, shown in FIG. 21, the second hair strand 92 comprises a second root portion 922 and a second hair strand body 923 integrally extended form the second root portion 922, the second root portion 922 is embedded into the second glue base 91 when the glue material is applied on the second hair strand 92.

The integration of the root portions 822 and 922 into the corresponding glue bases 81 and 91 ensures a strong bond that minimizes the risk of hair shedding or separation. This structural feature contributes to the longevity and durability of the hair weft, making it suitable for regular wear. By extending the hair strand bodies 823 and 923 from their respective root portions 822 and 922, the design allows for natural movement and flexibility. This mimics the behavior of real hair, enhancing the realism of the hair extension. The strands can move freely, which prevents stiffness and ensures a more dynamic appearance when worn.

The integration of the root portions into the glue bases also creates a more natural transition from the glued area to the visible hair. This design minimizes the appearance of any artificial attachment points, making the hair weft blend more seamlessly with the wearer's natural hair.

The first hair weft unit 80 comprises a first weft edge 83 formed by the first glue base 81 and the first root portion 822 of the first hair strand 82, the second hair weft unit 90 comprises a second weft edge 93 formed by the second glue base 91 and the second root portion 922 of the second hair strand 92. Both of the first weft edge 83 and the second weft edge 93 are not formed with folded back hair.

Conventional hair extensions often involve folded-back hair at the weft edges, which can create a bulkier, less natural appearance, particularly at the base. By avoiding this folding process, the weft edges 83 and 93 of the hair wefts present a much smoother and more natural look, wherein the hair appears to flow directly from the base without any visible "loops" or folded hair sections.

Without the need to fold back the hair, the weft edges are thinner and less bulky. This thinner edge enhances the overall comfort for the wearer, as the hair extension sits more naturally and snugly against the scalp, avoiding any excess thickness that might cause discomfort or make the hair extension feel unnatural.

The non-folded design allows the hair strands 82 and 92 to extend directly from their root portions 822 and 922 without any interruptions caused by folding. This results in a more realistic flow of the hair, as it behaves in a manner closer to natural hair growth. The strands can lay flat, fall more fluidly, and move more naturally when the wearer is in motion.

In designs where hair is folded back, the folded section often creates points of tension or stress on the strands, making them more prone to breakage over time. By eliminating the folded-back structure, this design reduces the risk of hair strands breaking at the base. The glue base 81 and 91 directly embed the root portions 822 and 922, creating a stronger bond and increasing the longevity of the hair weft.

Folded-back hair can sometimes lead to tangling or matting at the weft edge, especially after prolonged use. By not folding the hair, the hair weft of the present invention remains tangle-free at the base, making it easier to maintain, comb, and style. This feature ensures that the hair extension retains its neat appearance over time.

The non-folded weft edges allow for a smoother transition between the weft and the wearer's natural hair. This seamless blending is crucial for achieving a more natural look, particularly when the hair extension is used in partial installations or when it is clipped into existing hair. The hair weft becomes almost imperceptible, enhancing the overall aesthetic.

The absence of folded-back hair also simplifies the process of cutting and styling the hair weft. The wearer or stylist can trim the weft edge without worrying about exposing loops of hair or compromising the structure of the weft. This flexibility allows for more customization and precision in achieving the desired hairstyle.

Not forming folded-back hair can streamline the production process. The manufacturing of non-folded edges requires fewer steps, which can reduce production time and cost. Additionally, this method reduces the amount of material needed, as there is no need to fold extra hair strands into the glue bases 81 and 91.

The first hair weft unit 80 further comprises a stitching means 84 for fixing the first hair strand 82. In this embodiment, the stitching means 84 comprises a first quilting line 841 and a third quilting line 843, the first glue base 81 is applied between the first quilting line 841 and the third quilting line 843. A distance between the first quilting line 841 and the third quilting line 843 in this embodiment is smaller than 3 mm, preferred 0.5 mm to 2 mm, such as 1 mm or 2 mm. In this embodiment, the distance between the first quilting line 841 and the third quilting line 843 is embodied to be 1 mm.

The first weft edge 83, which is formed by the first glue base 81 between the first quilting line 841 and the third quilting line 843, and the first root portion 822 of the first hair strand 82, is fixed with two sewing lines with extremely narrow intervals to form a cluster of hair bundles. After being coated with glue and dried and fixed, the first weft edge 83 is in an irregular hair bundle shape, and the appearance is similar to that of a hand tied weft.

As shown in FIG. 19, the first quilting line 841 and the third quilting line 843 are applied in parallel to secure the first hair strand 82 of the first hair weft unit 80. These sewing lines ensure that the first root portion 822 of the first hair strand 82 are fixed in place while creating an aesthetic that mimics hand tied weft.

The glue material is applied between the first and third quilting lines 841 and 843, embedding the first root portion 822 and providing additional fixation to prevent any movement of the hair strands. The tight spacing of the quilting lines 841 and 843 and the application of glue create small clusters of hair strands, giving the first hair weft unit 80 a hand tied appearance. This irregular formation makes the hair weft look more natural, as hand tied wefts are typically characterized by subtle variations in hair distribution, resulting in a more authentic look.

Since, the two quilting lines 841 and 843 are positioned very close together, so that it is ensured that the first hair elements 821 are tightly secured. The first glue base 81 applied between them further locks the root portion 822 of the first hair strand 82 in place, providing additional strength and preventing the strands from coming loose or shifting over time. This increases the longevity of the hair weft by ensuring that the hair remains securely fastened, even with frequent use.

The narrow distance, 1 mm in this case, between the quilting lines 841 and 843 results in a thin weft edge 83. This thin edge is less bulky compared to traditional designs, enhancing the comfort of the hair weft when worn. The wearer will experience a smoother, more snug fit, as the hair weft conforms more naturally to the scalp without adding unnecessary bulk. The tightly packed quilting lines 841 and 843 allow the first hair elements 821 to be grouped into small bundles, which enhances the flow and movement of the hair. This design ensures that the first hair strand 82 fall naturally, without appearing overly rigid or synthetic. The irregular hair bundle shape also adds to the realistic aesthetic of the first hair weft unit 80.

In addition, by using two quilting lines in close proximity, the design optimizes the use of materials such as the glue material. The minimal distance between the lines reduces the amount of glue needed, while still providing a secure hold. This efficiency can lower production costs without compromising the quality or durability of the first hair weft unit 80.

The irregular hair bundle shape formed by this design allows for more versatile styling options. The clusters of hair can be shaped and styled more flexibly, which is particularly important for achieving more complex or voluminous hairstyles. The hand tied-like appearance gives stylists and wearers greater freedom to create different looks while maintaining a natural aesthetic.

The use of quilting lines combined with the application of glue between them streamlines the production process. Compared to more complex hand tied or hair wefts prepared by machine insertion technology, this method allows for faster production without sacrificing the quality of the final product. The efficiency of this approach reduces labor time and costs, making it easier to scale production to meet consumer demand.

Since the first hair elements 821 are firmly embedded between the two quilting lines 841 and 843 and bonded with glue, the risk of hair loss or unraveling when the first hair weft unit 80 is cut is minimized. This allows the wearer or stylist to cut and shape the hair weft as needed without worrying about loosening the first hair elements 821, ensuring a cleaner and more precise cut.

In this embodiment, when the hair weft is worn on the wear, the first hair weft unit 80 is an upper weft unit above the second weft unit 90. In other words, compared with the second hair weft unit 90, the first hair weft unit 80 is away from the skin of the head of the wearer. The first hair weft unit 80 is placed on top of the second weft unit 90, so that this layered arrangement ensures that the first hair weft unit 80 appears more prominently on the exterior of the hair weft, providing the desired coverage and volume while the second weft unit 90 lies closer to the scalp to offer a secure foundation.

The combination of the secure stitching, glue base, and thin weft edge results in a more comfortable and natural-feeling hair weft for the wearer. The hair extension formed by the first weft unit 80 will be less noticeable when worn, improving overall satisfaction, especially during extended wear.

The second hair weft unit 90 may further comprise a mesh yarn 94 on a side of the second glue layer 91, the other side of the second glue layer 91 of the second weft unit 90 is attached to the first glue layer 81 of the first weft unit 80 by a bonding glue, so as to form the final product of the hair weft of this embodiment.

The mesh yarn 94 provides a supportive framework that adds structural integrity to the second weft unit 90. It is positioned on one side of the second glue layer 91 adjacent to the scalp when the hair weft is worn on the wearer, allowing the second hair strand 92 to be securely fixed while also enabling flexibility. The mesh yarn 94 adds additional support, ensuring that the hair strands in the second weft unit 90 remain securely in place. This stability is essential for maintaining the overall shape of the hair weft and preventing any sagging or displacement.

Figure 20:
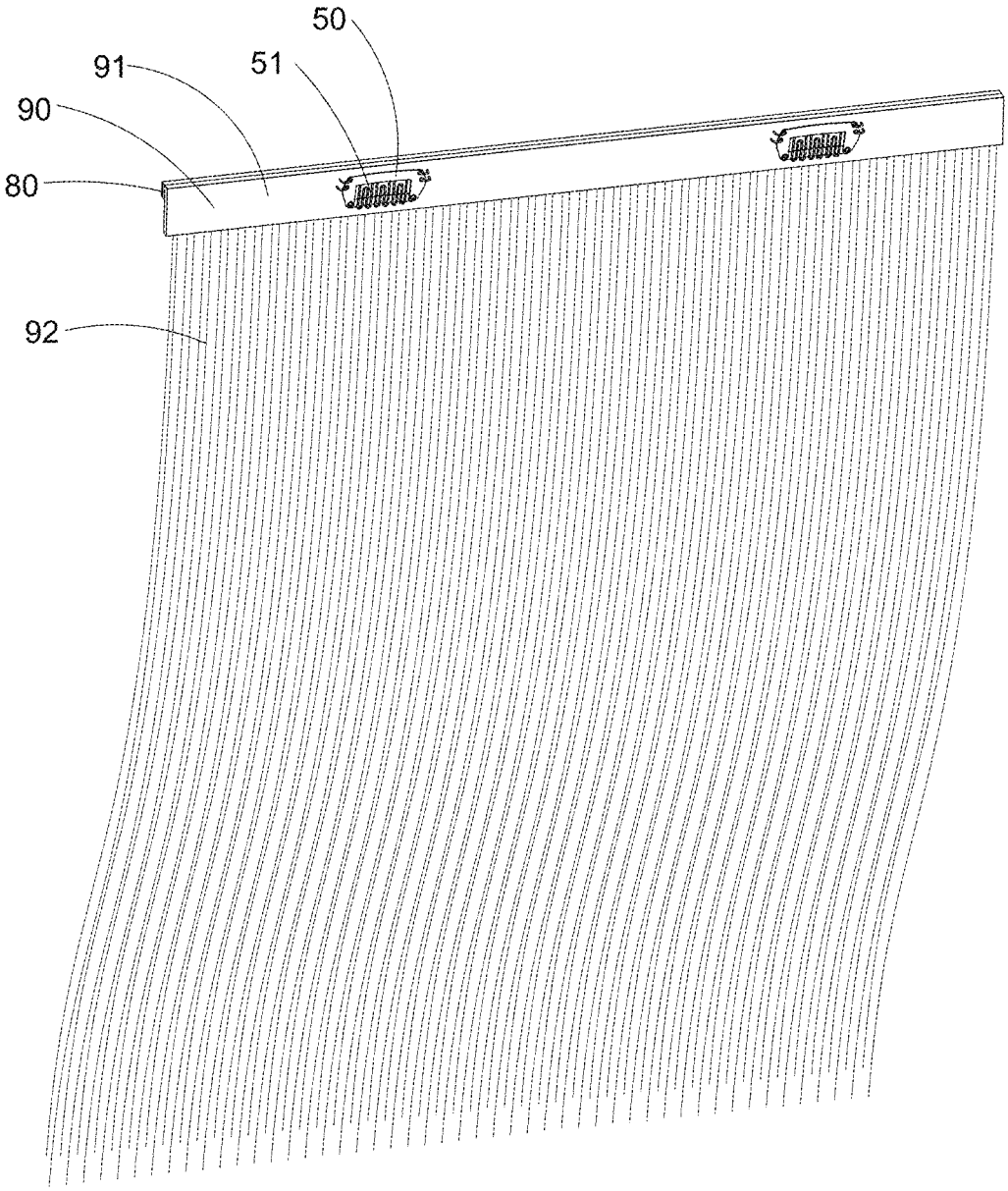
FIG. 20 is another perspective view of the hair weft according to the above preferred embodiment of the present invention.

As shown in FIG. 20 and FIG. 21 of the drawings, an attaching unit 50 can be mounted on the second hair weft unit 90 at a side of the second hair weft unit 90 adjacent to the mesh yarn 94 for coupling the hair weft to the hair of the user. Accordingly, the second glue base 91 has a top surface that is adhered to the first glue base 81, and a bottom surface of the mesh yarn 94 for mounting the attaching unit 50.

In this embodiment, the attaching unit 50 comprises a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the first hair weft unit 80 and the second hair weft unit 90, as well as the corresponding fixing holes 5111 for connecting the fixing base 511 to the first hair weft unit 80 and the second hair weft unit 90.

The fixing base 511 has two sets of fixing holes 5111 at two end portions thereof, and the clipping element 51 comprises two connecting strings 514 mounted to each of the two sets of fixing holes 5111 respectively.

The fixing base 511 is made of a resilient material, and in a closed state, the clipping member 512 is attached to the fixing base 511. When in a use state, the two end portions of the fixing base 511 can be pressed to deform the fixing base 511, so that the clipping member 512 is spaced apart from the fixing base 511 to define the clipping groove 513.

When the hair weft of the present invention is worn on the head of the user, the attaching unit 50 is attached to the head of the user, the second weft unit 90 is provided under the first weft unit 80 and is more close to the scalp. The density of the two hair weft units 80 and 90 can be the same, or the second hair strand 92 has a higher density and is positioned nearer the scalp to create a fuller and more secure attachment.

Figure 22:
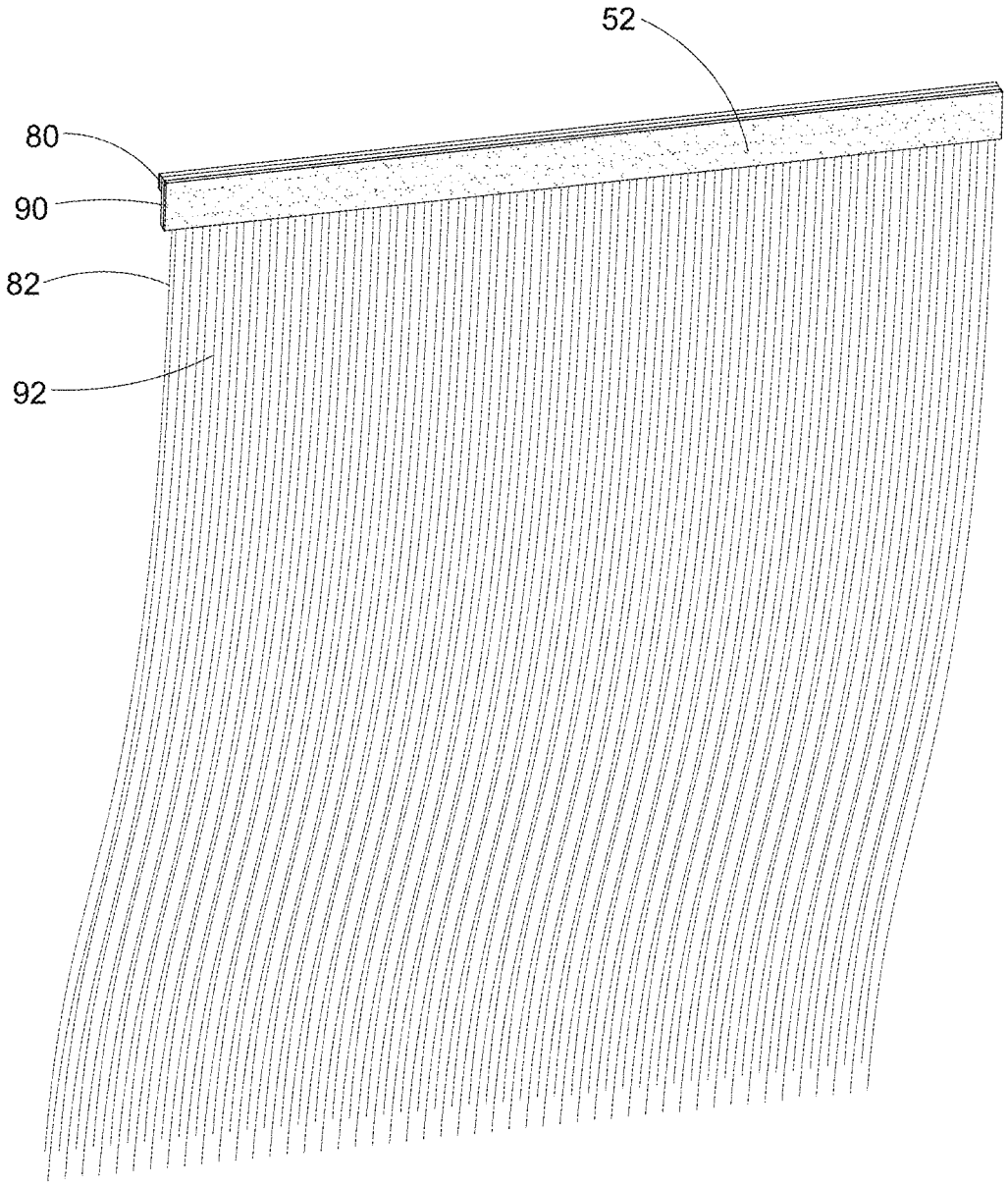
FIG. 22 is a perspective view of an alternative hair weft according to the above preferred embodiment of the present invention.

Referring to FIG. 22 of the drawings, as an alternative mode, the hair weft further comprises an attaching unit 50 which is coupled to a bottom side of the second glue base 91 of the second hair weft unit 90 for coupling the hair weft to the hair of the user. In this embodiment, the attaching unit 50 comprises a double-sided binding tape 52, one side of the double-sided binding tape 52 is attached to the mesh yarn 94 of the second hair weft unit 90, the other side of the double-sided binding tape 52 is used for adhering the hair of the user during usage.

By incorporating the attaching unit 50, the clipping member 51 and the double-sided binding tape 52 make the hair weft easier to attach and blend with natural hair, making the hair weft suitable for various applications such as clip-ins or tape-ins.

By positioning the first hair weft unit 80 above the second unit 90, the hair weft creates a more natural appearance. The first weft unit 80, which is more visible, can be designed with more aesthetic considerations, while the second weft unit 90 remains close to the scalp to provide a secure base for the hair weft. This layer-like arrangement mimics the natural growth of hair, where the outer layers of hair cover and blend with the inner layers, giving the hair weft a fuller and more natural look.

The combination of the first and second hair weft units 80 and 90 enhances the blending capabilities of the weft. The variation in the arrangement of the first and second hair strands 82 and 92 provides better concealment of the weft when applied to the natural hair of the wearer. This creates a more natural transition between the hair of the wearer and the hair weft, minimizing visibility and making the attachment points nearly imperceptible.

Referring to FIG. 23A to FIG. 28 of the drawings, a preparing method of the hair weft is illustrated. The preparing method of the hair weft comprises a step of preparing the first hair weft unit 80, a step of preparing the second hair weft unit 90 and a step of bonding the first hair weft unit 80 and the second hair weft unit 90.

Figure 23A:
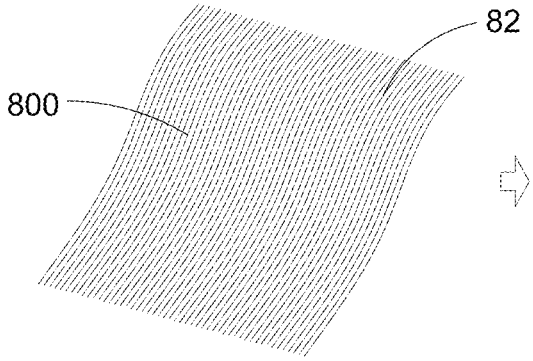
FIGS. 23A, 23B, 23C, 23D, 23E, 23F are schematic views illustrating the preparing of the first hair weft unit of the hair weft according to the above preferred embodiment of the present invention.
Figure 23B:
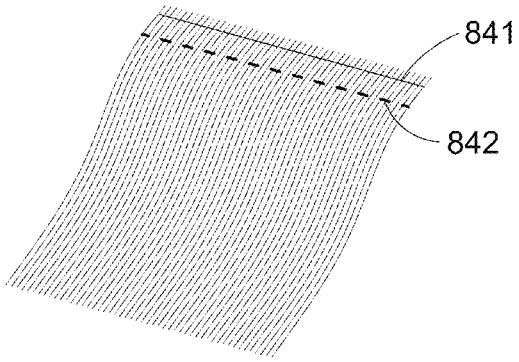

More specifically, as shown in FIGS. 23A to 23B, in the step of preparing the first hair weft unit 80, a double-needle sewing machine is used to quilt the first hair strand 82 on the top to get a fixed hair curtain. The first quilting line 841 uses a pure cotton sewing thread, and a second quilting line 842 uses a water-soluble sewing thread. The double-needle sewing machine has a stitch length of 30-35 stitches per inch, and the distance between the two needles is 3-4 mm.

Figure 23D:
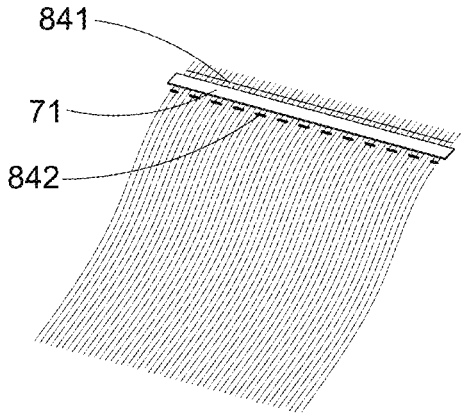
Figure 23C:
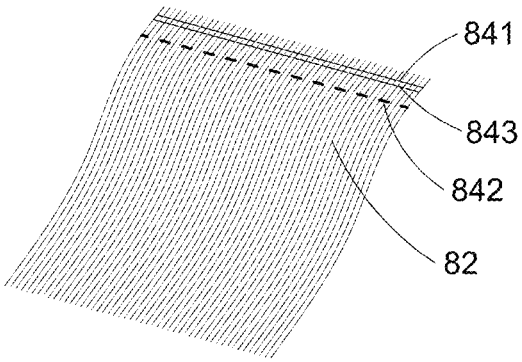

As shown in FIG. 23C, use a single-needle sewing machine to run another quilting line, the third quilting line 843, between the two quilting lines 841 and 842. Another pure cotton sewing thread is used for the third quilting line 843. The distance between the two pure cotton sewing lines in this embodiment is smaller than 3 mm, such as 1 mm in this embodiment.

A single double-needle sewing machine alone cannot achieve the extremely narrow stitching gap of 0.5-3 mm between the quilting lines 841 and 843. By combining the capabilities of both the double-needle and single-needle sewing machines, the process achieves an intricate level of stitching precision that enhances the aesthetic and structural qualities.

The double-needle machine forms the two initial quilting lines 841 and 842 with a 3-4 mm gap, while the single-needle machine adds the third quilting line 843 in between, filling in the gap with high accuracy. This combination produces a more tightly constructed hair curtain with minimized spacing, providing a smooth and seamless edge. The tightly stitched quilting lines 841 and 843 allow the first hair elements 821 to be grouped into small bundles, which enhances the flow and movement of the hair. This design ensures that the first hair strand 82 fall naturally, without appearing overly rigid or synthetic. The irregular hair bundle shape with the thin first weft edge 83 also adds to the realistic aesthetic of the first hair weft unit 80.

Alternatively, the first quilting line 841 and the third quilting line 843 may be subsequently formed one by one by a single-needle machine.

As shown in FIG. 23D, lay the first hair weft material 800 flat on a glass panel, and use a first masking tape 71 to stick it along the third cotton sewing line 843 to cover the first hair strand 82. This will prevent the glue material from penetrating into the bottom hair during the subsequent gluing step and also play a shaping role.

Figure 23E:
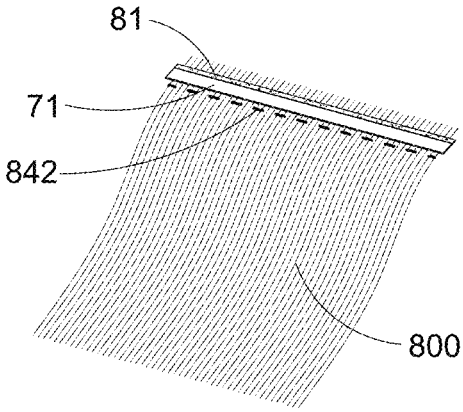

As shown in FIG. 23E, use a polycarbonate glue or polyurethane glue, an adhesive, and a diluent or thinner to mix in proportion to obtain the glue material for making the first weft edge 83.

Apply the glue material between two cotton sewing threads 841 and 843, and scrape repeatedly with a scraper to make the glue contact with the hair evenly and fix the first hair weft material 800. After finishing, put the first hair weft material 800 in a drying box for drying at a temperature of 45-50° C. for 15 minutes.

Take out the first hair weft material 800 and continue to apply the second coat of the glue material. After completion, put the first hair weft material 800 into the drying box for drying at a temperature of 45-50° C. for 15 minutes.

Take out the first hair weft material 800 and continue to apply the third coat of the glue material. After completion, put the first hair weft material 800 into the drying box for drying at a temperature of 45-50° C. for 120 minutes.

Take out the first hair weft material 800 apply the first coat of the glue material on the back, and put the first hair weft material 800 into the drying box for drying at 45-50° C. for 15 minutes.

Take out the first hair weft material 800 and continue to apply the second coat of the glue material. After completion, put the first hair weft material 800 into the drying box for drying at a temperature of 45-50° C. for 15 minutes.

Take out the first hair weft material 800 and continue to apply the third coat of the glue material. After completion, put the first hair weft material 800 into the drying box for drying at a temperature of 45-50° C. for 240 minutes.

Figure 23F:
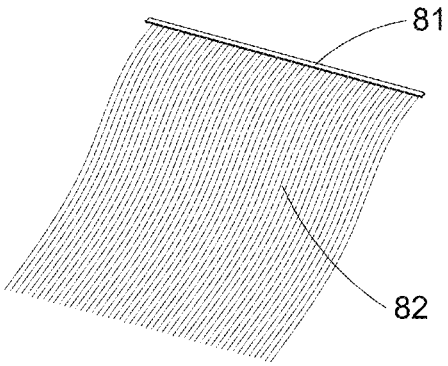

The excess hair 1.5 to 2 cm above the first quilting line 841 is cut to obtain the first hair weft unit 80, as shown in FIG. 23F.

Figure 27:
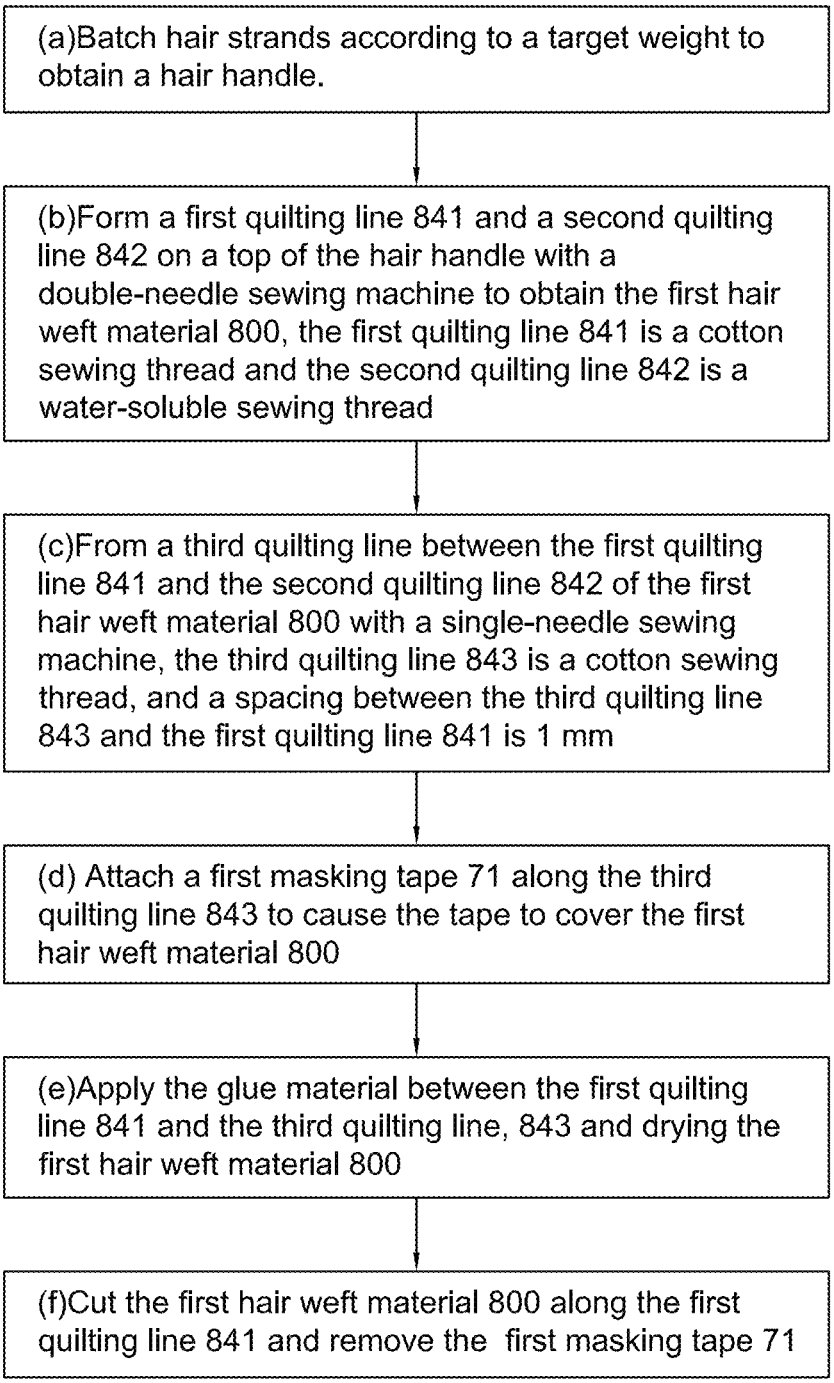
FIG. 27 is a flowchart of a preparation process of the first hair weft unit of the hair weft according to the above preferred embodiment of the present invention.

Accordingly, referring to FIG. 27, the step of preparing the first hair weft unit 80 comprises the following steps.

(a) Batch hair strands according to a target weight to obtain a hair handle.

(b) Form a first quilting line 841 and a second quilting line 842 on a top of the hair handle with a double-needle sewing machine to obtain the first hair weft material 800. Specifically, the first quilting line 841 is a cotton sewing thread and the second quilting line 842 is a water-soluble sewing thread. The double-needle sewing machine has a gauge of 30-35 stitches per inch, and a spacing between the first quilting line 841 and the second quilting line 842 is 3-4 mm.

(c) From a third quilting line between the first quilting line 841 and the second quilting line 842 of the first hair weft material 800 with a single-needle sewing machine. Specifically, the third quilting line 843 is a cotton sewing thread, and a spacing between the third quilting line 843 and the first quilting line 841 is 1 mm.

(d) Attach a first masking tape 71 along the third quilting line 843 to cause the tape to cover the first hair weft material 800. Specifically, a textured paper tape is pasted along the third quilting line 843 made of cotton, such that the textured paper tape covers the first hair strand 82, thereby preventing the glue material from penetrating into the interior of the first hair strand during the step of applying the glue material, and shaping the first hair weft material 800.

(e) Apply the glue material between the first quilting line 841 and the third quilting line, 843 and drying the first hair weft material 800.

(f) Cut the first hair weft material 800 along the first quilting line 841 and remove the first masking tape 71. Specifically, the protruding excess hair strands are cut off along the first quilting line made of cotton, retaining only 1 mm of hair strands above the third quilting line, which can make the weft edge of the hair weft invisible when wearing the hair weft, and the hair weft is stable while not being affected by the sewing threads.

Figure 24A:
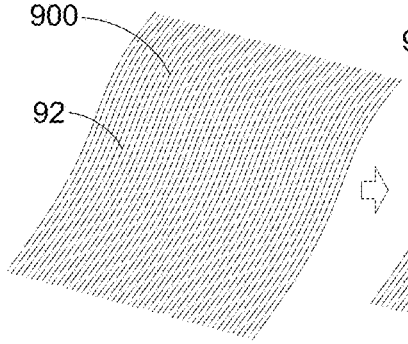
FIGS. 24A, 24B, 24C, 24D, 24E, 24F, 24G and 24H are schematic views illustrating the preparing of the second hair weft unit of the hair weft according to the above preferred embodiment of the present invention.
Figure 24B:
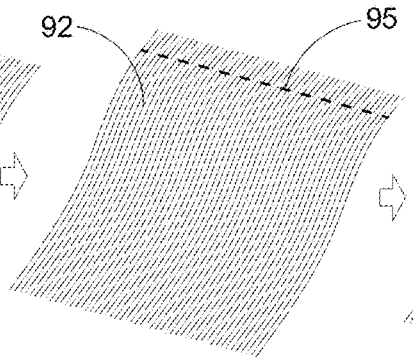

In the step of preparing the second hair weft unit 90, as shown in FIGS. 24A to 24B, a single-needle sewing machine is used to run a water-soluble sewing thread 95 about 4 to 5 cm away from the top of the second hair strand 92 to fix the second hair elements 92 to obtain a second hair weft material 900 and prevent the second hair elements 92 from spreading during production.

Figure 24C:
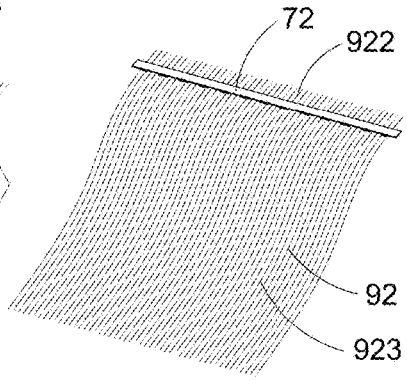

As shown in FIG. 24C, stick a second masking tape 72 about 1.2-1.5 cm away from the top of the second hair strand 92, so that the second masking tape 72 covers the hair to prevent the glue from penetrating into the bottom of the second hair strand 92 during the subsequent gluing step, and play a shaping role.

Figure 24E:
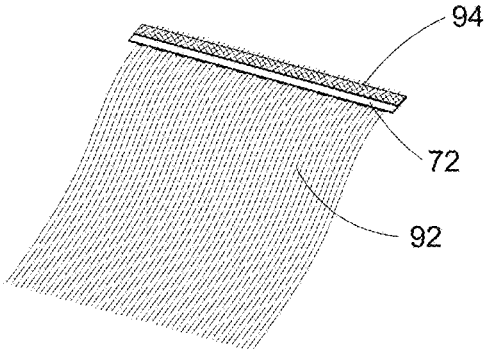
Figure 24D:
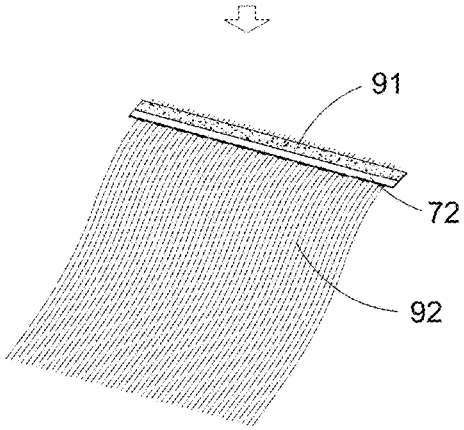

As shown in FIG. 24D, glue brushing and drying: Use a polycarbonate glue or polyurethane glue, an adhesive, and a diluent or thinner to mix in proportion to obtain the glue material for making the second weft edge 93.

Apply the glue material to the second hair strand 92 above the second masking tape 72 and use a scraper to scrape repeatedly to make the glue material contact with the second hair strand 92 evenly and fix it. After finishing, put it in the drying box for drying at a temperature of 50-55° C. for 10-15 minutes.

Take out the second hair weft material 900 and continue to apply the second coat of the glue material. After finishing, as shown in FIG. 24E, add a layer of mesh yarn 94 on the glue surface and scrape it with a scraper to make the mesh yarn 94 flat and put the second hair weft material 900 into the drying box for drying at a temperature of 50-55° C. for 60 minutes.

Figure 24F:
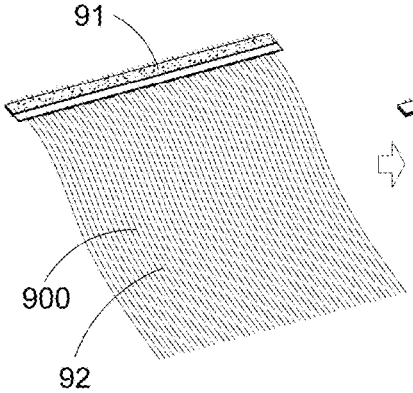

As shown in FIGS. 24F, take out the second hair weft material 900, apply the first coat of the glue material on the side without the mesh yarn 94, and then put the second hair weft material 900 into the drying box for drying at 50-55° C. for 30 minutes;

Take out the second hair weft material 900, apply a second coat of the glue material on the side without the mesh yarn 94, and put the second hair weft material 900 into the drying box for drying at a temperature of 50-55° C. for 240 minutes.

Figure 24G:
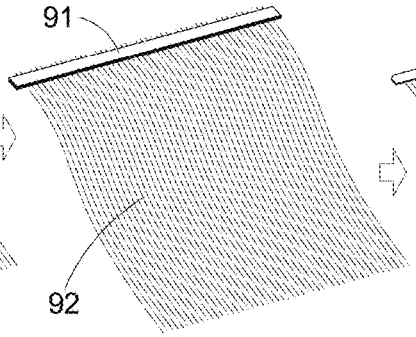
Figure 24H:
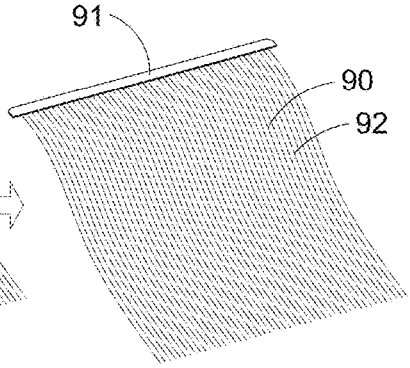
Figure 25A:
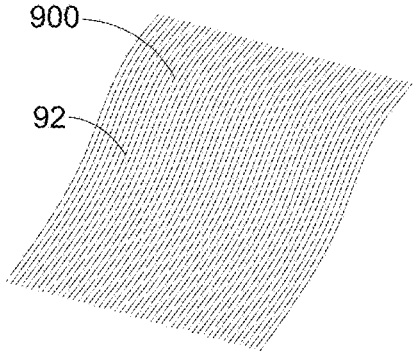
FIGS. 25A, 25B, 25C, 25D, 25E, 25F and 25G are schematic views illustrating the preparing of the second hair weft unit of the hair weft according to to an alternative mode of the above preferred embodiment of the present invention.
Figure 25B:
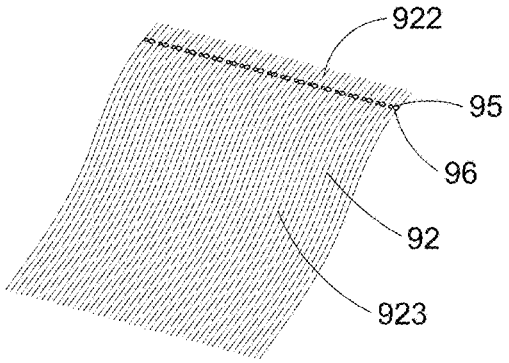
Figure 25D:
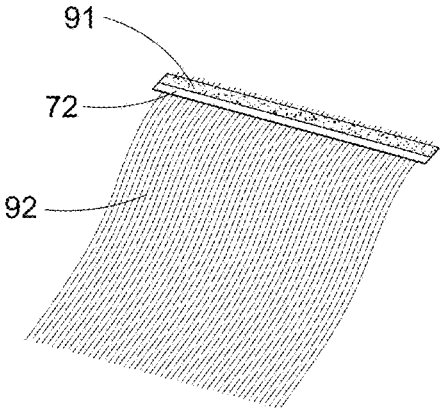
Figure 25C:
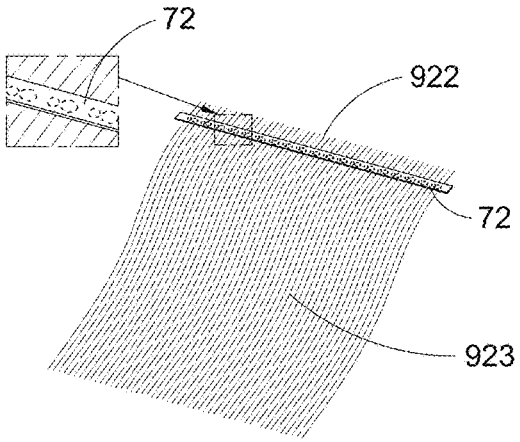
Figure 25E:
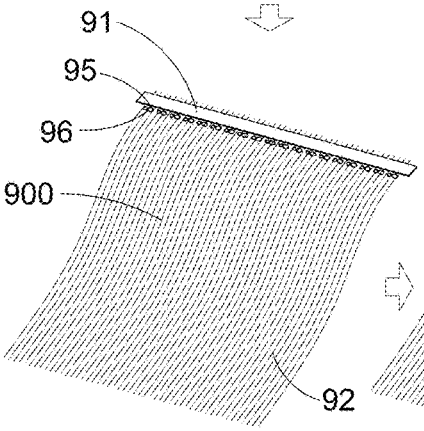
Figure 25F:
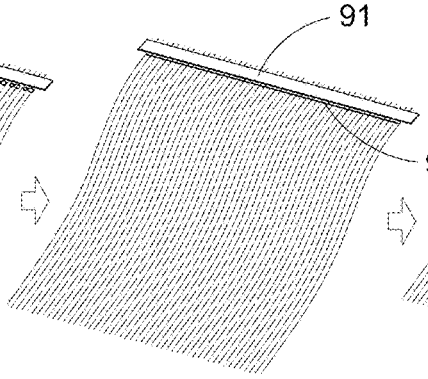
Figure 25G:
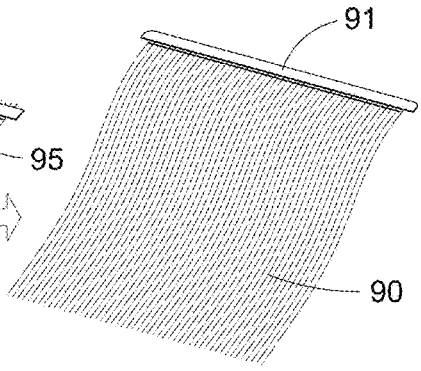
Figure 26:
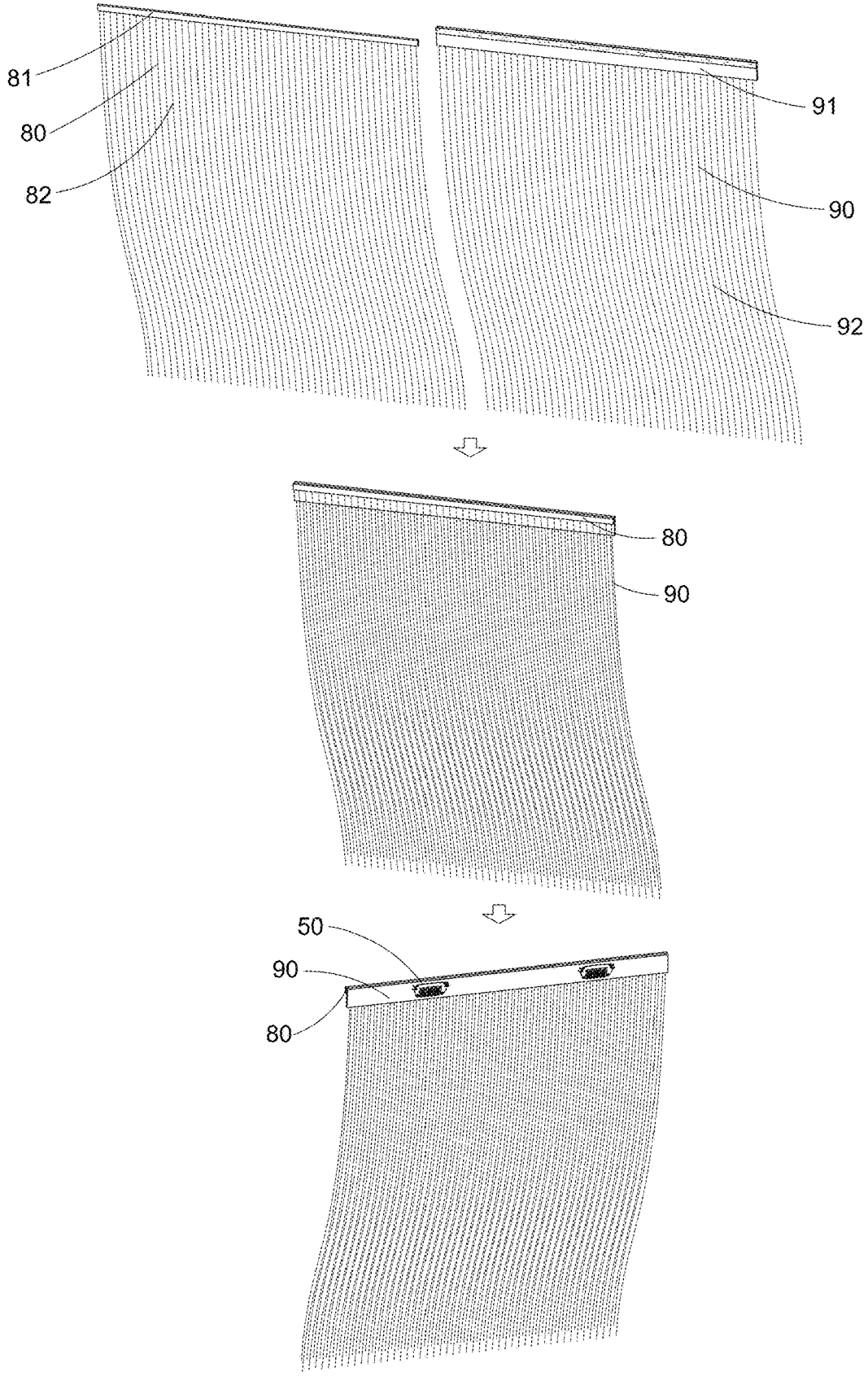
FIG. 26 is a schematic view illustrating the bonding of the two hair weft units of the hair weft according to the above preferred embodiment of the present invention.

Take out the second hair weft material 900, use the second masking tape 72 to stick out the weft edge height range of 0.8 to 1 cm, and then, as shown in FIGS. 24G to 24H, cut the excess weft edge to obtain the second hair weft unit 90.

Figure 28:
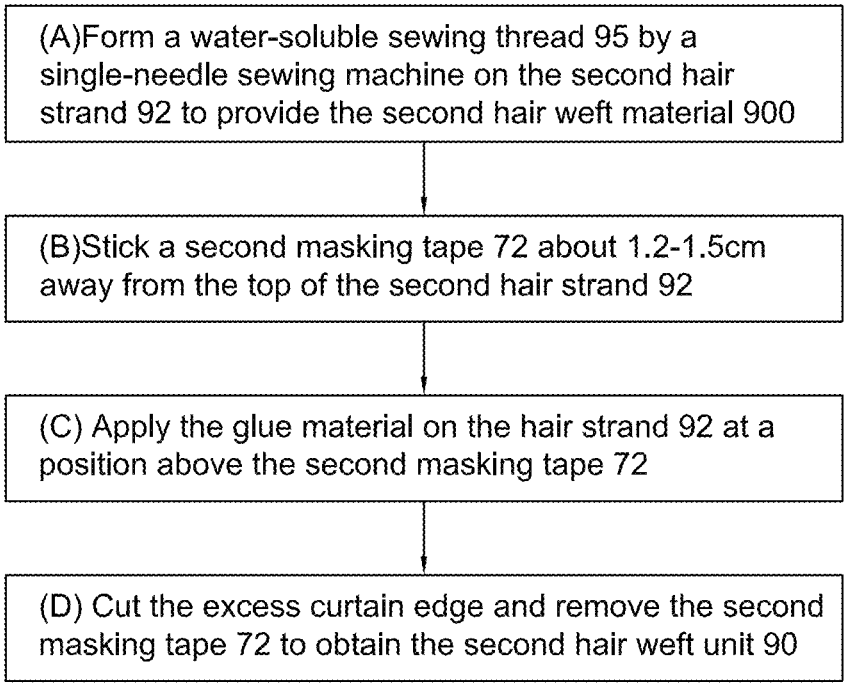
FIG. 28 is a flowchart of a preparation process of the second hair weft unit of the hair weft according to the above preferred embodiment of the present invention.

Accordingly, referring to FIG. 28, the step of preparing the second hair weft unit 90 comprises the following steps.

(A) Form the water-soluble sewing thread 95 by a single-needle sewing machine on the second hair strand 92 to provide the second hair weft material 900.

(B) Stick a second masking tape 72 about 1.2-1.5 cm away from the top of the second hair strand 92.

(C) Apply the glue material on the hair strand 92 at a position above the second masking tape 72.

(D) Cut the excess weft edge and remove the second masking tape 72 to obtain the second hair weft unit 90.

The step of preparing the second hair weft unit 90 may further comprise a step of attaching the mesh yarn 94 on the glue material on the second hair weft material 900. Preferably, when the mesh yarn 94 is attached to the second hair weft material 900, the other side of the second hair weft material 900 is applied with the glue material for one or more times.

Alternatively, as shown in FIG. 25A to FIG. 25G of the drawings, a double-needle sewing machine is used to run a water-soluble sewing thread 95 and a cotton sewing thread 96 about 4 to 5 cm away from the top of the second hair strand 92 to fix the second hair elements 92 to obtain the second hair weft material 900 and prevent the second hair elements 92 from spreading during production. The two intersecting stitching lines, the water-soluble sewing thread 95 and the cotton sewing thread 96, can be arranged in an "8" pattern. In this alternative mode, the mesh yarn 94 may be omitted.

In the step of bonding the first hair weft unit 80 with the second hair weft unit 90, the top edges of the two hair weft units 80 and 90 are aligned, and the first weft edge 83 which has a smaller length is attached to the second weft edge 93 which has a larger length by a glue.

The preparing method may further comprise a step of soaking the hair weft. More specifically, the hair weft prepared by the first hair weft unit 80 and the second hair weft unit 90 is put in a softener. Since the second quilting line 842 and the water-soluble sewing thread 95 are water-soluble sewing threads, the second quilting line 842 and the water-soluble sewing thread 95 will dissolve and disappear when the hair weft is soaked.

More specifically, in the soaking step of the hair weft, put 100 g of finished hair weft into 1 kg of 40° C. water, add 2-3 g of sodium hypochlorite solution, and soak for 5 minutes;

After soaking, wash three times with 40° C. water;

After cleaning, put the finished hair weft in 1 kg of 50° C. water, add 30 g of softener, and soak for 10 minutes;

After soaking, put the finished hair weft in 1 kg of 50° C. clean water, add 40 g of softener, and soak for 10 minutes.

After soaking, the hair weft can be into a centrifuge for dehydration and drying, a dense-tooth comb can be used to comb the hair weft to scrape off the floating hair on the product, then the hair weft can be put into water to moisten it slightly, spread it flat on an iron plate, use a brush to scrape off excess water, and put the hair weft into a drying room at 50° C. for drying.

Further, the preparation method may further comprise a step of ironing and combing the hair weft, stacking the hair weft, and bundling and packaging for transportation It is to be noted that in this document, relational terms such as first and second are used only to distinguish one entity or operation from another, and do not necessarily require or imply the existence of any such actual relationship or order between these entities or operations. Furthermore, the terms "including", "having", or any other variant thereof, are intended to cover non-exclusive inclusion, such that a process, method, article, or apparatus including a set of elements includes not only those elements, but also other elements not expressly listed, or elements that are inherent to such process, method, article, or apparatus may be included. Without further limitation, the fact that an element is defined by the phrase "including a . . . " does not exclude the existence of another identical element in the process, method, article, or apparatus including the element.

Each of the embodiments in this specification is described in a related manner, and it is sufficient to refer to each embodiment for similarities between embodiments, and each embodiment focuses on the differences from other embodiments. In particular, for a system embodiment, since it is basically similar to the method embodiment, it is described in a simpler manner, and it is sufficient to refer to a part of the description of the method embodiment where relevant.

The above description is only some embodiments of the present disclosure, and is not intended to limit the scope of the present disclosure. Any modifications, equivalent substitutions, improvements, etc. made within the spirit and principles of the present disclosure are included in the scope of the present disclosure.

What is claimed is:

1. A method of preparing a hair weft, comprising the following steps:

fixing a first hair strand to a first glue base to provide a first hair weft unit by embedding a first root portion of the first hair strand into the first glue base and forming one or more quilting lines which are sewing threads fixed on the first root portion of the first hair strand and applying a glue material to the one or more quilting lines and the first root portion to form the first glue base, wherein the first root portion is integrally extended from a first hair strand body of the first hair strand, said first hair strand body is extended from a bottom of said first glue base and is positioned under said first glue base;

providing a second weft unit comprising a second glue base and a second hair strand fixed to the second glue base; and attaching the second glue base to the first glue base.

2. The method, as recited in claim 1, wherein the step of fixing the first hair strand to the first glue base comprises the steps of forming two quilting lines on the first root portion of the first hair strand and applying the glue material between the two quilting lines and the first root portion to form the first glue base.

3. The method, as recited in claim 2, wherein a distance between the two quilting lines is smaller than 3 mm.

4. The method, as recited in claim 2, wherein a distance between the two quilting lines is 0.5 mm to 2 mm.

5. The method, as recited in claim 2, wherein a distance between the two quilting lines is 1 mm.

6. The method, as recited in claim 2, wherein the two quilting lines are parallel cotton threads.

7. The method, as recited in claim 2, wherein the step of providing the second weft unit comprises a step of embedding a second root portion of the second hair strand into the second glue base.

8. The method, as recited in claim 2, further comprising a step of mounting an attaching unit to the second weft unit, wherein the attaching unit comprises one of a clipping member and a double-sided binding tape.

9. The method, as recited in claim 1, wherein the step of providing the second weft unit comprises a step of embedding a second root portion of the second hair strand into the second glue base.

10. The method, as recited in claim 9, wherein each of the first glue base and the second glue base comprises one of polyurethane glue and polycarbonate glue.

11. The method, as recited in claim 1, further comprising a step of mounting an attaching unit to the second weft unit.

12. A method of preparing a hair weft, comprising the following steps:

fixing a first hair strand to a first glue base to provide a first hair weft unit;

providing a second weft unit comprising a second glue base and a second hair strand fixed to the second glue base; and attaching the second glue base to the first glue base;

wherein the step of fixing the first hair strand to the first glue base comprises the following steps:

forming a first quilting line and a second quilting line on the first hair strand, wherein the first quilting line is a cotton sewing thread and the second quilting line is a water-soluble sewing thread; and forming a third quilting line between the first quilting line and the second quilting line, wherein the third quilting line is a cotton sewing thread.

13. The method, as recited in claim 12, wherein a distance between said first quilting line and said third quilting line is smaller than 3 mm.

14. The method, as recited in claim 12, wherein the first quilting line and the second quilting line are formed by a double-needle sewing machine, the third quilting line is formed by a single-needle sewing machine.

15. The method, as recited in claim 12, further comprising the steps of:

attaching a first masking tape along the third quilting line;

applying a glue material between the first quilting line and the third quilting line to form the first glue base; and removing the first mashing tape.

16. The method, as recited in claim 12, wherein the step of providing the second weft unit comprises a step of embedding a second root portion of the second hair strand into the second glue base.

17. The method, as recited in claim 16, wherein each of the first glue base and the second glue base comprises one of polyurethane glue and polycarbonate glue.

18. The method, as recited in claim 16, further comprising a step of attaching a mesh yarn to said second glue base.

* * * * *